US007549507B2

(12) United States Patent
Aida et al.

(10) Patent No.: US 7,549,507 B2
(45) Date of Patent: Jun. 23, 2009

(54) DUCT WALL STRUCTURE

(75) Inventors: Kiyoshi Aida, Kure (JP); Nobuo Shimono, Kure (JP); Kenji Sumimori, Kure (JP); Yasuyuki Owa, Kure (JP); Kiyoshi Motoyama, Kure (JP)

(73) Assignee: Babcock-Hitachi Kabushiki Kaisha, Tokyo (JP)

( * ) Notice: Subject to any disclaimer, the term of this patent is extended or adjusted under 35 U.S.C. 154(b) by 465 days.

(21) Appl. No.: 10/565,785

(22) PCT Filed: Aug. 6, 2004

(86) PCT No.: PCT/JP2004/011352

§ 371 (c)(1),
(2), (4) Date: Jan. 25, 2006

(87) PCT Pub. No.: WO2005/015538

PCT Pub. Date: Feb. 17, 2005

(65) Prior Publication Data

US 2006/0272282 A1 Dec. 7, 2006

(30) Foreign Application Priority Data

Aug. 7, 2003 (JP) ..... 2003-289076

(51) Int. Cl.

| | |
|---|---|
| ***E04F 13/08*** | (2006.01) |
| ***E04F 17/04*** | (2006.01) |
| ***E01F 8/00*** | (2006.01) |
| ***E01F 8/02*** | (2006.01) |
| ***E04B 1/82*** | (2006.01) |
| ***E04B 1/86*** | (2006.01) |
| ***E04B 1/98*** | (2006.01) |
| ***E04B 2/56*** | (2006.01) |
| ***E04B 5/43*** | (2006.01) |

(52) U.S. Cl. ..... 181/224; 181/293; 52/293.3; 52/796.1

(58) Field of Classification Search ..... 181/224, 181/293; 52/293.3, 796.1

See application file for complete search history.

(56) References Cited

U.S. PATENT DOCUMENTS 1,495,993 A * 6/1924 Farmer ..... 476/12

(Continued)

FOREIGN PATENT DOCUMENTS

JP 51-143915 12/1976

(Continued)

OTHER PUBLICATIONS

English language Abstract of JP 51-143915.

(Continued)

*Primary Examiner*—Jeffrey Donels
*Assistant Examiner*—Christina Russell
(74) *Attorney, Agent, or Firm*—Greenblum & Bernstein, P.L.C.

(57) ABSTRACT

The invention relates to an inner heat insulating and inner sound insulating structure of an HRSG duct wall in which a turbine combustion high temperature and high velocity gas whose temperature is approx. 650° C. and velocity is 30 meters per second (m/s) flows, wherein heat insulating members are filled between the inner plate at the gas flow side and the outer plate at the atmospheric side, an intermediate member is disposed at a middle portion between the inner plate and the outer plate, spacing between the inner plate and the intermediate member is retained by stud bolts while spacing between the outer plate and the intermediate member is retained by stud bolts, and the stud bolt and the outer plate are tightened via a vibration deadening washer. When the vibration deadening washer is disposed at a position in the interior of the heat insulating member, where it is not influenced by the temperature of a gas flowing in the interior of the duct and is not influenced by wearing resulting from the gas, that is, the washer is attached at a position whose temperature becomes 400° C. or less, which is half the entire thickness of the heat insulating member, apart from the high temperature side, or at a position therebelow, the durability thereof is high and the heat insulating and sound insulating performance can be maintained for a longer period of time.

13 Claims, 24 Drawing Sheets

U.S. PATENT DOCUMENTS

| | | | | | |
|---|---|---|---|---|---|
| 2,310,274 | A | * | 2/1943 | Beckett | 431/182 |
| 2,900,127 | A | * | 8/1959 | Smith | 417/423.15 |
| 2,915,134 | A | * | 12/1959 | Braund | 181/156 |
| 5,509,242 | A | * | 4/1996 | Rechsteiner et al. | 52/270 |

FOREIGN PATENT DOCUMENTS

| | | | |
|---|---|---|---|
| JP | 51143915 | A * | 12/1976 |
| JP | 52-92501 | | 8/1977 |
| JP | 1-94136 | | 4/1989 |
| JP | 6-10646 | | 1/1994 |
| JP | 9-279717 | | 10/1997 |
| JP | 09279717 | A * | 10/1997 |
| JP | 10-121599 | | 5/1998 |
| JP | 10121599 | A * | 5/1998 |
| JP | 10-205680 | | 8/1998 |
| JP | 11-351488 | | 12/1999 |
| JP | 2000-27333 | | 1/2000 |
| JP | 2000027333 | A * | 1/2000 |
| JP | 2002-206211 | | 7/2002 |
| JP | 2002206211 | A * | 7/2002 |

OTHER PUBLICATIONS

English language Abstract of JP 11-351488.
English language Abstract of JP 52-92501.
English language Abstract of JP 9-279717.
English language Abstract of JP 2000-27333.
English language Abstract of JP 2002-206211.
English language Abstract of JP 10-121599.
English language Abstract of JP 10-205680.
English language Abstract of JP 6-10646.
English language Abstract of JP 1-94136.

* cited by examiner (a)

PRIOR ART (b)

PRIOR ART (a)

PRIOR ART (a)

DUCT WALL STRUCTURE

TECHNICAL FIELD

The present invention relates to a duct wall structure aiming at heat insulation and sound insulation of an exhaust heat recovery boiler, and in particular to a duct wall structure for heat insulation and sound insulation, which attempts to insulate heat of a high temperature gas, whose temperature is approximately 650° C., generated by gas turbine combustion and prevents low frequency noise, generated by gas turbine combustion, from leaking outside.

BACKGROUND ARTS

Recently, demand has increased for an exhaust heat recovery boiler (there may be cases where it is called an HRSG or a heat recovery steam generator) which generates steam by collecting energy held by a combustion gas generated in a gas turbine and carries out power generation by using steam generated by a steam turbine.

FIG. 20 shows a duct wall 12 for an HRSG. A high-temperature and high-velocity gas 11 whose temperature is approx. 650° C. and velocity is 30 meters per second (m/s) is caused to flow from a gas turbine (not illustrated) into the duct wall 12, and heat thereof is thermally collected by a heat transfer tube bundle 13 installed inside the duct wall 12, and the gas whose temperature becomes comparatively low is exhausted through a smoke stack 14.

FIG. 21 is a side elevational view of the duct wall 12, which is observed in the direction of the arrow A shown in FIG. 20. The duct wall 12 occupies a greater part of the surface area of the entire HRSG, and reliability of the entire plant can be improved by making excellent the heat insulation and sound insulation performance of the duct wall 12.

FIG. 22 through FIG. 24 are sectional views in the direction parallel to the gas flow direction of the duct wall 12 of a prior art HRSG. The prior art duct wall 12 is generally structured so that, in order to insulate heat of the high temperature and high velocity gas 11 flowing in the interior of a duct, a heat insulating member 4 such as rock fibers, ceramic fibers, etc., is retained between the outer plate 2 at the outer side of the duct and the inner plate 3 at the inner side thereof. And, simultaneously, the heat insulating member 4 is used as a sound insulating material by utilizing a sound insulation function held by the heat insulating member 4.

The standard heat insulating structure of the duct wall 12 of the prior art HRSG shown in FIG. 22 (FIG. 22(*a*) is a sectional view of the duct wall 12, which is parallel to the gas flowing direction therein, and FIG. 22(*b*) is a partially enlarged view of FIG. 22(*a*) is such that a plurality of heat insulating members 4 are laminated and disposed between the outer plate (casing) 2 at the outer side of the duct wall 12 and the inner plate (inner lagging) 3 at the inner side of the duct into which a high temperature and high velocity gas 11 flows, the outer plate 2 and inner plate 3 are retained by stud bolts 5 and insulation pins 25 each having a function of fixing the heat insulating member 4, the inner plate 3 is mounted by providing a disk-shaped washer 36 and a nut 31 at the inner plate 3 side of the stud bolt 5 one end of which is supported on the outer plate 2, and a speed washer 26 is attached to the insulation pin 25 located at a conjunction part of respective layers of the heat insulating member 4, whereby the respective heat insulating members 4 are fixed.

In addition, such a construction of a prior art duct wall 12 has been known, which is shown in FIG. 23 (FIG. 23(*a*) is a sectional view of the duct wall 12 in the direction parallel to the gas flowing direction therein, and FIG. 23(*b*) is a view taken along the direction shown by the arrows A-A in FIG. 23(*a*)). The duct wall 12 shown in FIG. 23 is of a double heat insulating structure in which an intermediate member 6 is installed between the outer plate 2 and the inner plate 3, the outer plate 2 and intermediate member 6 are connected to each other by a stud bolt 5B, and the intermediate member 6 and inner plate 3 are connected to each other by a stud bolt 5A.

Further, a duct wall 12 has been known, which is shown in FIG. 24 (FIG. 24(*a*) is a sectional view of the duct wall 12 in the direction parallel to the gas flowing direction thereof, and FIG. 24(*b*) is a sectional view taken along the line A-A in FIG. 24(*a*)). The duct wall 12 shown in FIG. 24 is also of a double heat insulating structure, filed by the present applicant, in which an intermediate member 6 and a middle plate 9 are inserted between the outer plate 2 and the inner plate 3, the outer plate 2 and inner plate 3 are connected not by a single stud bolt 5, but the outer plate 2 and the intermediate member 6 are connected to each other by a stud bolt 5B, and the middle plate 9 and inner plate 3 are connected to each other by a stud bolt 5A.

Also, temperature distribution 100 between the inner plate 3 and outer plate 2 of the duct is shown on the left side of the sheet of FIG. 23(*a*) and FIG. 24(*a*).

In the structure of the duct wall 12 shown in FIG. 24, such a construction has generally been known in which, in order to insulate heat of a high temperature and high velocity gas 11 flowing in the interior of the duct wall 12, two layers of heat insulating members consisting of heat insulating members 4A and 4B respectively made of rock fibers, ceramic fibers, etc., are disposed between the inner plate 3 and the middle plate 9 and between the outer plate 2 and the middle plate 9. Since the heat insulating members 4A and 4B have a sound insulating function, the duct wall 12 in which the heat insulating members 4A and 4B are placed between the outer plate 2 and the inner plate 3 can bring about a sound insulating structure. Such a connection method is generally employed for the outer plate 2 and the inner plate 3, in which the heat insulating members 4A and 4B are placed therebetween, and are usually connected to each other by means of stud bolts 5A and 5B and nuts 7A and 7B.

However, although an acoustic absorption structure of double layers of heat insulation of the duct wall 12 shown in FIG. 24 has excellent sound block-out performance, the weight is contrarily increased, and there are many disadvantages such as an increase in processing, working and designing costs, etc. Therefore, there was a necessity in newly developing a cost-suppressed heat insulation and sound insulation structure.

In the meantime, transmission sound from the interior of an HRSG into the exterior thereof is measured as noise. Where no silencer is provided in the interior of the HRSG, since an exhaust gas of a gas turbine internally exists in the HRSG without any acoustic energy of the turbine exhaust gas (high temperature and high velocity gas) being dampening, it is necessary to improve the sound block-out performance of the HRSG wall as a sound insulating countermeasure.

Sound transmitting through the duct wall 12 is classified into two types which are air-borne sound and solid-borne sound, wherein the sound insulation performance of the duct wall 12 is determined by a sound-borne loss of the outer plate 2, inner plate 3 and heat insulating member 4, wherein it is considered that almost all of the transmission sound is solid-borne sound which is transmitted from the inner plate 3 to the outer plate 2 via the stud bolts 5.

The duct wall structure disclosed in FIG. 22 through FIG. 24 is based on a method for dampening solid transmission sound by lengthening the channel of solid transmission sound, wherein the intermediate member 6 is disposed between the inner plate 3 and the outer plate 2, the inner plate 3 and the intermediate member 6 are connected to each other by means of stud bolts 5A and nuts 7A, and the outer plate 2 and the intermediate member 6 are further connected to each other by means of stud bolts 5B and nuts 7B. However, such a structure is general in terms of insulating the solid transmission sound, and a structure similar thereto is disclosed in Japanese Unexamined Patent Publications Nos. Sho-51-143915 and Hei-11-351488.

Further, a vibration deadening washer 8 of a structure in which a vibration deadening material 8*b* shown in FIG. 2 is placed and nipped between two plate materials 8*a* has been known as a vibration deadening and sound insulating material for buildings. A general example thereof is disclosed in Japanese Unexamined Patent Publications Nos. Sho-52-92501, Hei-9-279717 and 2000-27333, etc.

Patent Document 1 Japanese Unexamined Patent Application No. Sho-51-143915

Patent Document 2 Japanese Unexamined Patent Application No. Hei-11-351488

Patent Document 3 Japanese Unexamined Patent Application No. Sho-52-92501

Patent Document 4 Japanese Unexamined Patent Application No. Hei-9-279717

Patent Document 5 Japanese Unexamined Patent Application No. 2000-27333

DISCLOSURE OF THE INVENTION

There are the following problems to be solved in the above-described prior arts.

(1) If the vibration deadening washer 8 shown in FIG. 2 is disposed on the inner plate 3 of the duct wall 12 of the HRSG, the portion of the inner plate 3 on which the vibration deadening washer 8 is disposed is directly exposed to a high temperature and high velocity gas 11 whose temperature is approx. 650° C. or more. Since the heat resistance of the vibration deadening washer 8 is insufficient, it cannot be used for places, exposed to the high temperature and high velocity gas 11, of the duct wall 12 of the HRSG.

(2) Since the side of the vibration deadening washer 8 is directly exposed to a high temperature and high velocity gas 11 if the vibration deadening washer 8 shown in FIG. 2 is disposed on the inner plate 3 of the duct wall 12, there is a possibility for the vibration deadening material 8*b* to be scattered. If the vibration deadening material 8*b* is scattered and adhered to internal devices of the HRSG, there is a fear that the corresponding devices will be seriously damaged.

(3) In the duct wall structure in which the inner plate 3 is placed and nipped between a pair of disk-shaped washers 36 shown in FIG. 22, the inner plate 3 is thermally elongated and contracted due to changes in the internal temperature of the HRSG when starting and stopping a plant consisting of a gas turbine and HRSG, and a shearing force is generated in the disk-shaped washer 36 due to a frictional resistance resulting from the elongation and contraction, wherein it is impossible for the disk-shaped washer 36 to be used for a longer period of time.

(4) Also, the vibration deadening washer 8 shown in FIG. 2 is very weak against a shearing force. Where a pair of vibration deadening washers 8 is used instead of the disk-shaped washer 36 (FIG. 22) and the inner plate 3 of the duct wall 12 shown in FIG. 22 is placed and nipped therebetween, there is a possibility for the vibration deadening washers 8 not to achieve the function as a washer due to the shearing force.

(5) As regards the vibration deadening washer for buildings, which is disclosed in Japanese Unexamined Patent Publication No. Sho-52-92501, etc., a high-polymer adhesive, rubber, etc., are used as a vibration deadening member. However, such vibration deadening washers cannot be used for the internal heat insulation structure of the HRSG in which a high temperature and high velocity gas 11 whose temperature is approx. 650° C. and velocity is 30 meters per second (m/s) or so flows.

Therefore, it is an object of the invention to provide a heat insulating and sound insulating duct wall structure for an exhaust heat recovery boiler, etc., which is equipped with a vibration deadening structure having soundproofing performance similar to the above-described vibration deadening washer and capable of being used in a severe atmosphere where the same is exposed to a high temperature and high velocity gas as in the HRSG.

Also, it is another object of the invention to provide a heat insulating and sound insulating duct wall structure capable of being applied in a high temperature and high velocity gas atmosphere and displaying favorable vibration deadening performance and favorable sound insulating (soundproofing) performance and to provide a vibration isolating (vibration deadening) structure used for the corresponding duct wall structure.

In the meantime, using FIG. 25 showing the relationship between sound source levels and frequencies, a description is given of features of noise spectra of a gas turbine which becomes a noise source of the duct wall 12 of the HRSG. With respect to noise spectra g of a fan, etc., in a general boiler duct, it is general that the sound source becomes small in a low frequency zone whose frequency is 500 Hz or less. However, in regard to combustion sound of a large-diameter turbine used for the HRSG, there are many types in which the sound source level is high in a low frequency zone whose frequency is 250 Hz or less as in the sound source level h.

In the HRSG having such characteristics, it is an object to suppress low frequency sound, whose frequency is 250 Hz or less, in terms of soundproofing. For the acoustic characteristics of a gas turbine which is the above-described noise source, the following problems could not be solved in the prior arts.

(6) Even if, in order to suppress solid-borne sound, the channel of solid-borne sound is lengthened and a vibration deadening washer 8 (FIG. 2) is used, wearing of materials having excellent vibration deadening performance such as glass fibers, rock fibers, ceramic fibers, etc., is generated due to a high temperature and high velocity gas 11, flowing in an HRSG duct, whose temperature is approx. 650° C. and velocity is approx. 30 meters per second (m/s), wherein not only the soundproofing deteriorates but also it becomes difficult to maintain structural reliability for a longer period of time.

(7) Although the above-described vibration deadening washer 8 brings about a soundproofing effect only in a middle to high frequency zone whose frequency is 250 Hz or more, no effect can be expected in other low frequency zones. Therefore, a soundproofing effect cannot be expected in regard to noise generated in a gas turbine in which the sound source level is high in a low frequency zone whose frequency is 250 Hz or less.

Therefore, it is still another object of the invention to provide a heat insulating and vibration insulating structure, not having any structural problem as in the above-described (6), capable of bringing about a soundproofing effect with respect to a high-level gas turbine sound source in a low frequency zone in the above-described (7).

The objects of the invention can be achieved by the following solving means.

A first aspect of the invention is a heat insulating and sound insulating duct wall structure which composes a gas flow channel, and the same duct wall structure comprises:

an inner plate 3 at a gas flow side;

an outer plate 2 at the atmospheric side;

one or more intermediate members 6 with its lengthwise direction disposed in parallel to the inner plate 3 and outer plate 2 in an intermediate portion between the inner plate 3 and the outer plate 2;

a plurality of first supporting members 5A both ends of which are, respectively, fixed at the inner plate 3 and intermediate member 6 in order to retain the spacing between the inner plate 3 and the intermediate member 6;

a plurality of second supporting members 5B both ends of which are, respectively, fixed at the outer plate 2 and intermediate member 6 in order to retain the spacing between the outer plate 2 and the intermediate member 6;

a vibration deadening washer 8 attached to the connection portion at the intermediate member side of the second supporting members 5B; and a heat insulating member 4 filled in the clearance between the intermediate member 6, the first and second supporting members 5A and 5B and the vibration deadening washer 8 between the inner plate 3 and the outer plate 2.

According to the first aspect of the invention, since the vibration deadening washer 8 is disposed in the heat insulating member between the outer plate 2 and the inner plate 3, the vibration deadening washer 8 is not influenced by a high temperature and high velocity gas 11 whose temperature is approx. 650° C. and velocity is approx. 30 meters per second (m/s), wherein a vibration deadening material 8*b* whose vibration deadening performance is excellent as a component of the vibration deadening washer 8 can be used, a countermeasure against thermal elongation of a supporting structure of the vibration deadening washer 8 and sound insulating performance of the duct wall 12 can be maintained in a favorable state, and it becomes possible to maintain a duct structure having high reliability for a longer period of time.

A second aspect of the invention is a heat insulating and sound insulating duct wall structure according to the first aspect thereof, which is featured in that the fixing position of the first supporting members 5A and the intermediate member 6 and fixing position of the second supporting members 5B and the intermediate member 6 are shifted from each other in a gas flowing direction.

According to the second aspects of the invention, a duct wall structure for blocking out solid-borne sounds by lengthening the solid-borne sound channel (the inner plate 3→support member (stud bolt) 5A→intermediate member 6→support member (stud bolt) 5B→outer plate 2) between the outer plate 2 may be possible.

A third aspect of the invention is a heat insulating and sound insulating duct wall structure according to the first aspect thereof, which is featured in that the attaching position of the vibration deadening washer 8 is provided in an area in a duct wall whose temperature is 400° C. or less.

A fourth aspect of the invention is a heat insulating and sound insulating duct wall structure according to the first aspect thereof, which is featured in that the vibration deadening washer 8 is provided at half the entire thickness of the heat insulating member 4 filled between the inner plate 3 and the outer plate 2 or at the outer plate 2 side position from the half thereof.

According to the third and fourth aspects of the invention, if the vibration deadening washer 8 is disposed at a position where the temperature is approx. 350 through 400° C. and velocity is 0 meters per second (m/s), which is the position almost half the entire thickness of the heat insulating member 4 of the duct wall 12, or the position which is half the entire thickness of the heat insulating member 4 or the outer plate 2 side from the corresponding half thereof, the vibration deadening washer 8 is not influenced by a high temperature and high velocity gas 11, wherein a vibration deadening material 8*b* being available on the market, vibration deadening performance of which is excellent as a component of the vibration deadening washer 8, can be used.

A fifth aspect of the invention is a heat insulating and sound insulating duct wall structure according to the fourth aspect thereof, which is featured in that a heat insulating member 4B filled between the intermediate member 6 and the outer plate 6 is composed of a vibration deadening material or a vibration dampening material having a thickness which is greater by at least three times than the thickness of the outer plate 2, and is adhered to the outer plate 2 in a state where the heat insulating member 4B is compressed at a compression ratio of at least 10% of the entire thickness thereof.

According to the fifth aspect of the invention, since the heat insulating member 4 is compressed and supported at a compression ratio of at least 10% of the entire thickness thereof, adhesion of the outer plate 2, heat insulating material (sound insulating material) 4, intermediate member 6 and middle plate 9 can be maintained, wherein vibration deadening performance of the duct wall 12 can be maintained without bringing about any structural laxation therebetween.

Also, since a vibration deadening material (sound deadening material) 4 has a thickness which is greater by at least three times than the thickness of the outer plate 2, a bending distortion generated by flexure vibrations of the outer plate 2 is increased, and sufficient vibration dampening performance can be obtained.

A sixth aspect of the invention is a heat insulating and sound insulating duct wall structure according to the first aspect thereof, which is featured in that a plurality of holes 6A and 6B through which the second supporting members 5B are passed are provided in the intermediate member 6 in the lengthwise direction of the intermediate member 6.

According to the sixth aspect of the invention, since the intermediate member 6 is fixed by tightening a pair of vibration deadening washers 8 by passing through the second supporting member 5B in a plurality of holes 6A and 6B by means of nuts 7B, the intermediate members 6 can be retained.

A seventh aspect of the invention is a heat insulating and sound insulating duct wall structure according to the sixth aspect thereof, which is featured in that a plurality of holes 6A and 6B through which the second supporting member 5B secured at the intermediate member 6 are passed are composed with a hole 6A for fixing the vibration deadening washer 8 disposed at the middle part in the lengthwise direction of the intermediate member 6 and one or more sets of loose holes 6B disposed at the symmetrical positions of the intermediate member 6 in the lengthwise direction thereof centering around the corresponding fixing hole 6A.

According to the seventh aspect of the invention, since the second supporting members (stud bolts) 5B support the intermediate member 6 while sliding in the loose holes 6B even if a pair of vibration deadening washers 8 are tightened and fixed in the hole 6A for fixing the intermediate member via the second supporting members (stud bolts) 5B at the middle part of the intermediate member 6, thermal elongation of the intermediate member 6 can be absorbed, wherein since the loose holes 6B are sufficient even in the case of the intermediate members 6 attached to positions where the temperature conditions are different from each other, it becomes possible to use the intermediate members 6 of the same specification and standard.

An eighth aspect of the invention is a heat insulating and sound insulating duct wall structure according to the first aspect thereof, which is featured in that a plurality of intermediate members 6 are, respectively, disposed in both the gas flowing direction and the direction orthogonal thereto with the lengthwise direction thereof orthogonal to the gas flowing direction.

According to the eighth aspect of the invention, since it becomes easy for the intermediate member 6 to support the weight of the inner plate 3, the same becomes effective in a case where the weight of the inner plate 3 is dominant as a load operating on the inner plate 3, wherein the vibration deadening washers 8 can be supported by the intermediate member 6.

A ninth aspect of the invention is a heat insulating and sound insulating duct wall structure according to the first aspect thereof, which is featured in that a plurality of intermediate members 6 are, respectively, disposed in both the gas flowing direction and the direction parallel thereto with the lengthwise direction thereof parallel to the gas flowing direction.

According to the ninth aspect of the invention, since it becomes easy for the intermediate member 6 to support a wind load operating on the inner plate 3, the intermediate member 6 becomes effective in a case where the wind load is dominant as a load operating on the inner plate 3, and the vibration deadening washers 8 can be supported by the intermediate member 6.

A tenth aspect of the invention is a heat insulating and sound insulating duct wall structure according to the first aspect thereof, which is featured in that the inner plate 3 is composed of a plurality of inner plate members 3A laminated to each other, and the respective inner plate members 3A are provided with a plurality of holes H1, H2, . . . through which the first supporting member 5A is passed.

According to the tenth aspect of the invention, where the inner plate 3 is composed of a plurality of inner plate members 3A, it is possible to prevent a high temperature and high velocity gas 11 from flowing into the interior of the heat insulating member 4 between the inner plate 3 and the outer plate 2.

An eleventh aspect of the invention is a heat insulating and sound insulating duct wall structure according to the tenth aspect thereof, which is featured in that a plurality of holes H1, H2, . . . through which the first supporting member 5A secured in the respective inner plate members 3A are provided with a hole H1 for fixing the vibration deadening washer 8 disposed at the middle part of the inner plate member 3A and one of more sets of loose holes H2, H3, . . . disposed at symmetrical positions of the inner plate members 3A centering around the corresponding fixing hole H1.

According to the eleventh aspect of the invention, since the first supporting members (stud bolts) 5A can support the inner plate members 3A in the loose holes H2, H3, . . . while sliding therein even if the first supporting members (stud bolts) 5A are passed through the hole H1 for fixing the intermediate member and fixed therein at the middle part of the inner plate members 3A, thermal elongation of the inner plate members 3A can be absorbed, and loose holes H2, H3, . . . of the same dimension are sufficient even in the case of the inner plate members 3A attached to positions where the temperature conditions are different from each other. Therefore, it becomes possible to use the inner plate members 3A of the same specification and standard.

A twelfth aspect of the invention is a heat insulating and sound insulating duct wall structure according to the tenth aspect thereof, which is featured in that the respective inner plate members 3A are disposed so as to partially overlap with the inner plate member 3A adjacent thereto, the inner plate member 3A at the upstream side of a gas flow is installed on the inner plate member 3A at the downstream side thereof, and the inner plate member 3A at the upper side in the perpendicular direction is installed on the inner plate member 3A at the lower side in the perpendicular direction.

According to the twelfth aspect of the invention, even if the inner plate members 3A are subjected to thermal elongation, the thermal elongation can be absorbed by the respective inner plates 3A, and since a high temperature and high velocity gas 11 does not flow into the lower part of the inner plate members 3A, an inner plate structure whose durability is excellent can be brought about.

A thirteenth aspect of the invention is a heat insulating and sound insulating duct wall structure according to the first aspect thereof, which is featured in that a middle plate 9 for bifurcating the heat insulating member 4 is provided at the attaching position of the intermediate member 6 along the lengthwise direction of the inner plate 3 and outer plate 2.

According to the thirteenth aspect of the invention, the heat insulating and sound insulating duct wall structure is not subjected to influences of a high temperature and high velocity gas 11 whose temperature is approx. 650° C. and velocity is approx. 30 meters per second (m/s), and a vibration deadening material 8*b* having excellent vibration deadening performance may be used as a component of the vibration deadening washer 8, wherein a countermeasure against thermal elongation of the supporting structure of the vibration deadening washer 8 and improvement of sound insulating performance of the duct wall 12 are compatible. Also, since the middle plate 9 is provided, an excellent heat rejection effect and soundproofing effect thereof can be brought about, wherein a duct structure having high reliability can be maintained for a longer period of time.

A fourteenth aspect of the invention is a heat insulating and sound insulating duct wall structure according to the first aspect thereof, which is featured in that the vibration deadening washer 8 is composed of such a structure as a vibration deadening member 8*b* being placed and nipped between two plate-shaped members 8*a* and 8*a*.

According to the fourteenth aspect of the invention, the duct wall structure is not influenced by a high temperature and high velocity gas 11 whose temperature is approx. 650° C. and velocity is approx. 30 meters per second (m/s), and since a vibration deadening washer 8 which is available on the market can be used, this is advantageous in terms of costs.

A fifteenth aspect of the invention is a heat insulating and sound insulating duct wall structure which composes a gas flow channel, and the same duct wall structure comprises:

an inner plate 3 at a gas flow side;

an outer plate 2 at the atmospheric side;

a plurality of supporting members 5, both ends of which are fixed at the inner plate 3 and outer plate 2, for retaining the interval between the inner plate 3 and the outer plate 2;

a heat insulating member 4 filled in the clearance among the supporting members 5 located between the inner plate 3 and the outer plate 2; and a vibration deadening washer (vibration deadener inserted type washer) 18 composed of a tray-shaped pan 19 worked to be tray-shaped, which is attached to a connection portion between the supporting members 5 and inner plate 3, which are in contact with a gas flow, a vibration deadener 21 inserted into the tray-shaped pan 19, and an upper cover disk 20 matched with the inner diameter of the tray-shaped pan 19.

A sixteenth aspect of the invention is a component of a duct wall, which composes an inner plate 3 at a gas flow side; an outer plate 2 at the atmospheric side; a plurality of supporting members 5, both ends of which are fixed at the inner plate 3 and outer plate 2, for retaining the interval between the inner plate 3 and the outer plate 2; a heat insulating member 4 filled in the clearance among the supporting members 5 located between the inner plate 3 and the outer plate 2, and the same component being a vibration deadening washer (vibration deadener inserted type washer) 18 composed of:

a tray-shaped pan 19 worked to be tray-shaped, which is attached to a connection portion at the inner plate side of the supporting members 5 which are in contact with a gas flow; a vibration deadener 21 inserted into the tray-shaped pan 19; and an upper cover disk 20 matched with the inner diameter of the tray-shaped pan 19.

According to the fifteenth aspect and sixteenth aspect of the invention, the vibration deadening washer (vibration deadener inserted type washer) 18 may be used instead of a disk-shaped washer 36 (refer to FIG. 22) of a standard heat insulating structure of the duct wall 12 of a prior art HRSG, wherein the number of components is not increased, and, since the vibration deadener 21 used for the vibration deadener inserted type washer 18 is not exposed directly to a gas 11, there is no fear that the vibration deadener 21 is scattered, and the durability thereof is comparatively long. In addition, a pair of vibration deadener inserted type washers 18 between which the inner plate 3 is placed and nipped can withstand a shearing force generated in sections of the vibration deadener inserted type washers 18 by frictional resistance resulting from elongation of the inner plate 3 in line with changes in the internal temperature in starting or stopping a plant, wherein the sound insulating performance of the duct wall 12 can be maintained in a satisfactory state for a comparatively longer period of time and a duct structure having high reliability can be brought about.

A seventeenth aspect of the invention is an external heat insulating structure comprising a heat insulating member 4C. disposed at a further outer air side of the outer plate 2 of a duct wall structure described in the first aspect of the invention; an outer casing (lagging) 32 supported by the supporting members 5C attached to the outer plate 2 and disposed in a direction parallel to the lengthwise direction of the outer plate 2 with spacing opening from the outer plate 2; and a vibration deadening washer 18, described in the sixteenth aspect, which is fixed between the outer casing 32 and the supporting members 5C.

According to the seventeenth aspect of the invention, the vibration deadening washer (vibration deadener inserted type washer) 18 can effectively prevent solid-borne vibrations from leaking outside the duct wall 12.

BRIEF DESCRIPTION OF DRAWINGS

FIG. 18(*b*) is a partially enlarged view of FIG. 18(*a*); and FIG. 18(*c*) is a view taken along the line of the arrows A-A in FIG. 18(*b*);

FIG. 19(*b*) is a view taken along the line of the arrows A-A in FIG. 19(*a*); FIG. 19(*c*) is a partially enlarged view of FIG. 19(*b*);

BEST MODE FOR CARRYING OUT THE INVENTION

A description is given of embodiments with reference to the accompanying drawings.

Embodiment 1

Figure 1:
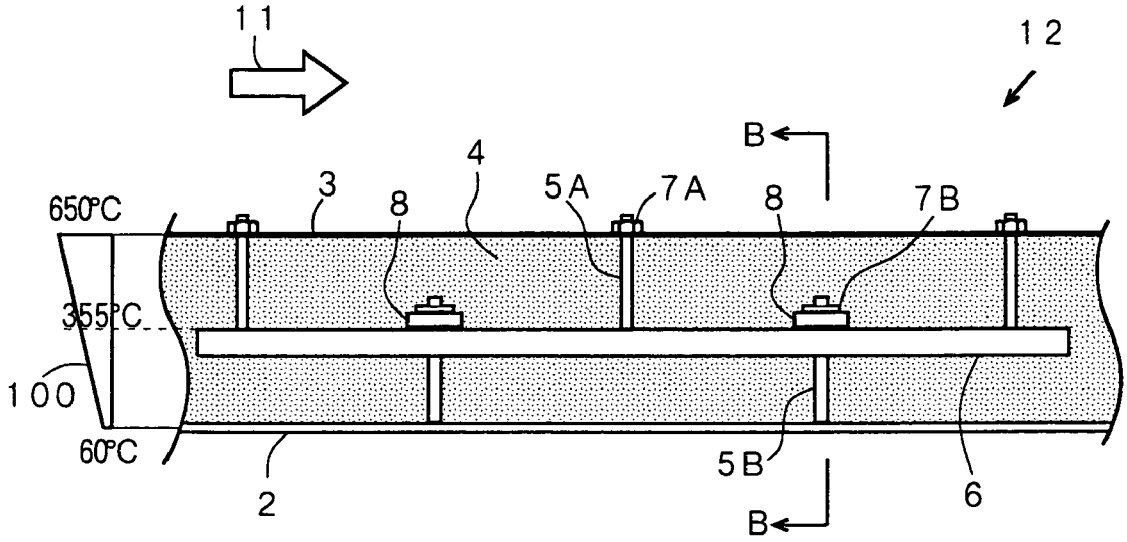
FIG. 1(*a*) is a longitudinal sectional view of a duct wall in the direction parallel to a gas flow direction of an HRSG according to Embodiment 1 of the invention, and FIG. 1(*b*) is a cross sectional view taken along the line of the arrows B-B in FIG. 1(*a*)
Figure 1:
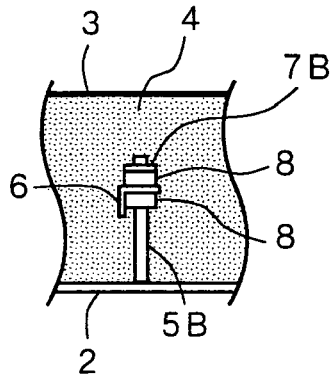

FIG. 1(*a*) shows a longitudinally sectional view of the duct wall 12 of an HRSG according to one embodiment in the direction parallel to a flow direction of a high temperature gas 11, and FIG. 1(*b*) shows a view taken along the line of the arrows B-B in FIG. 1(*a*). A plurality of intermediate members 6 are disposed along the outer plate 2 and inner plate 3 at a roughly middle part between the outer plate 2 at the atmospheric side and the inner plate 3 in the duct where a high temperature and high velocity gas 11 flows, and a heat insulating member 4 is disposed between the outer plate 2, inner plate 3 and intermediate members 6. The heat insulating member 4 is composed of a vibration deadening material or vibration dampening material such as glass fibers, rock fibers, ceramic fibers, etc., and the intermediate members 6 and outer plate 2 are tightened and fixed by stud bolts 5B and nuts 7B via vibration deadening washers 8 provided at the intermediate member 6 side. In addition, the inner plate 3 and intermediate members 6 are tightened and fixed by the stud bolts 5A and nuts 7A secured at the inner plate 3 side of the corresponding stud bolts 5A. Also, the stud bolts 5A and 5B are supporting members 5A and 5B according to the claims of the present invention.

Further, FIG. 1(*a*) shows temperature distribution 100 between the inner plate 3 and outer plate 2 of the duct.

In a wall structure for blocking out solid-borne sounds by lengthening the solid-borne sound channel (the inner plate 3→stud bolt 5A→intermediate member 6→stud bolt 5B→outer plate 2) between the above-described outer plate 2 and the inner plate 3, a vibration deadening washer 8 is installed at a position which is half the entire thickness of the heat insulating member 4 or at a position closer to the outer plate 2 side than the above-described position in the duct wall 12 of an HRSG in FIG. 1.

Although a high temperature and high velocity gas 11 whose temperature is approx. 650° C. and velocity is approx. 30 meters per second (m/s) flows in the interior of the duct, the vibration deadening washer 8 is installed at a position in the duct wall 12 in a temperature area, whose temperature is approx. 350 through 400° C. and flow velocity is 0 meters per second (m/s), which is the position half the entire thickness of the heat insulating member 4 being the position inside the duct wall 12 which is not influenced by any wearing due to the high temperature and high velocity gas 11 or at a position closer to the outside than the above position (that is, the outer plate 2 side).

Figure 2:
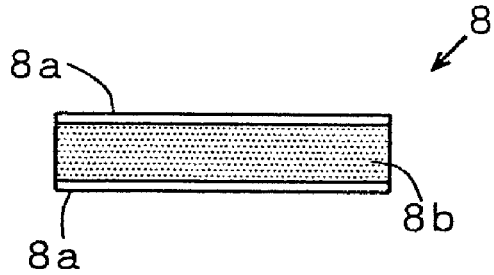
FIG. 2(*a*) is a sectional structural view of a vibration deadening washer used for a duct wall of an HRSG used conventionally, and FIG. 2(*b*) is a plan view thereof.
Figure 2:
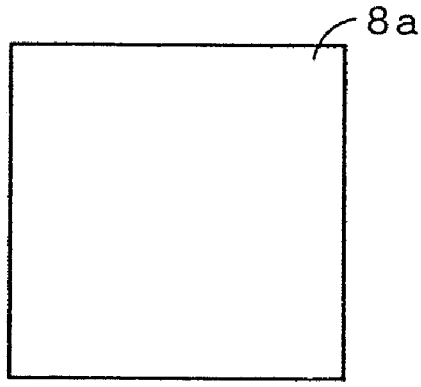

The sectional structure of the above-described vibration deadening washer 8 is as shown in FIG. 2(*a*). If the vibration deadening washer 8 is installed at a position whose temperature is approx. 350 through 400° C. and flow velocity is 0 meters per second (m/s), which is the position almost half the entire thickness of the duct wall 12 or at a position closer to the outer plate 2 than the above position even if the vibration deadening washer 8 is composed of a simple structure in which a vibration deadening material 8*b* is placed and nipped between two plates 8*a* as shown in FIG. 2, the vibration deadening washer 8 is not influenced by a high temperature gas 11, wherein a vibration deadening material 8*b* having excellent vibration deadening performance such as glass fibers, rock fibers, ceramic fibers, etc., may be used as a component of the vibration deadening washer 8. Also, FIG. 2(*b*) shows a plan view of the vibration deadening washer 8 where it is rectangular.

The heat resisting temperature of the vibration deadening material 8*b* is 400° C. for glass fibers, 600° C. for rock fibers, and 1300° C. for ceramic fibers. With such a construction in which the vibration deadening washer 8 is disposed at the position in the duct wall 12 of the present embodiment, the vibration deadening washer 8 is not influenced by a high temperature and high velocity gas 11, wherein all vibration deadening materials having excellent vibration deadening performance such as glass fibers, rock fibers, ceramic fibers, etc., may be used, which are available on the market.

Once wearing of the vibration deadening washer 8 begins to occur due to a high temperature and high velocity gas 11, the wearing amount thereof is acceleratively increased. However, if the vibration deadening washer 8 is installed at the position shown in the embodiment, there is no fear with respect to wearing.

In addition, with respect to a method for manufacturing the vibration deadening washer 8 shown in FIG. 2, a number of structures in which a vibration deadening material 8*b* is adhered between two plates 8*a* with an adhesive are manufactured prior to construction of an HRSG, whereby inexpensive vibration deadening washers 8 of a fixed quality can be obtained.

Figure 3:
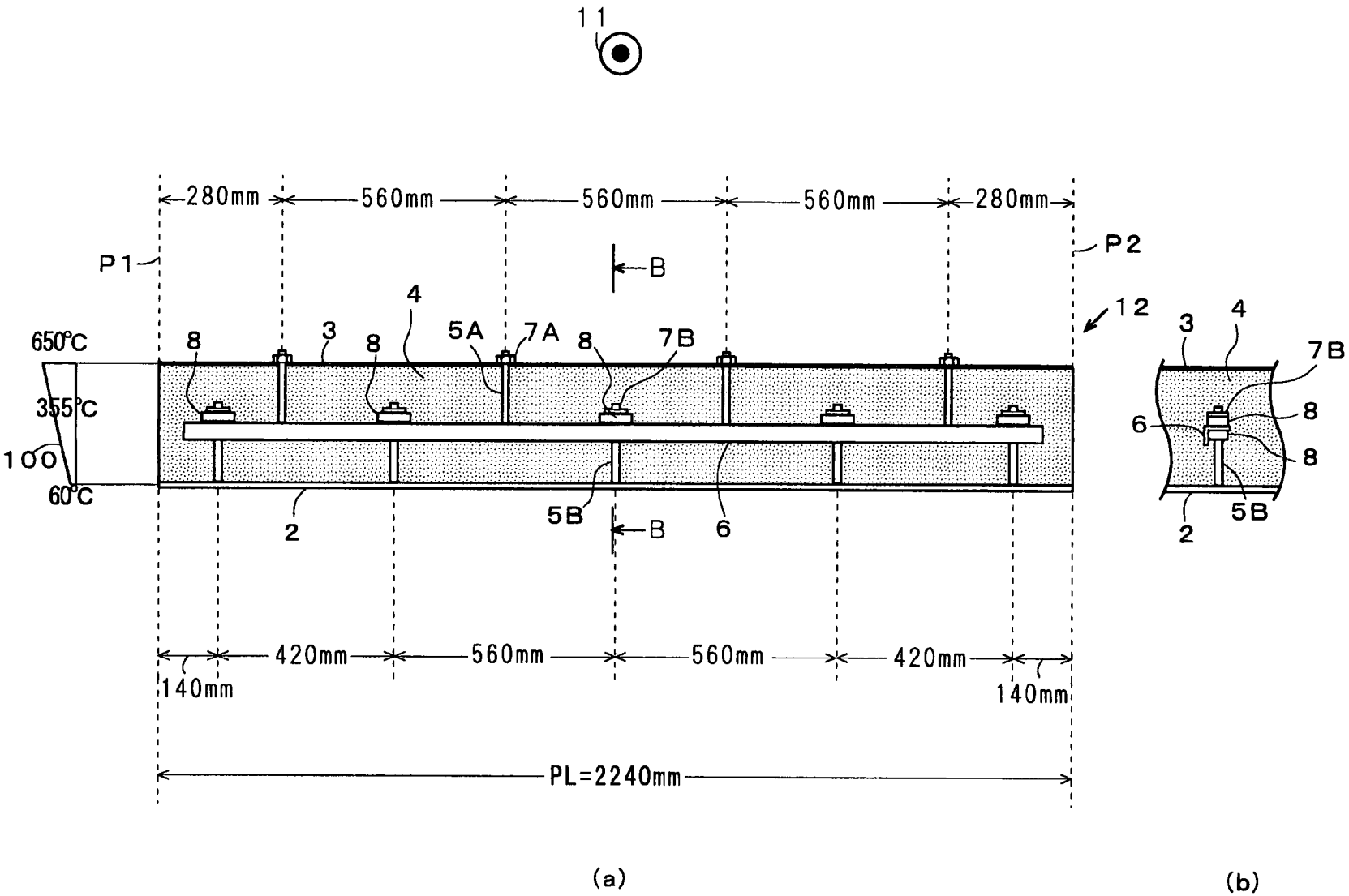
FIG. 3(*a*) is a longitudinal sectional view of a duct wall in the direction orthogonal to a gas flow direction of an HRSG according to Embodiment 1 of the invention, and FIG. 3(*b*) is a cross sectional view taken along the line of the arrows B-B in FIG. 3(*a*)

FIG. 3(*a*) shows a longitudinal sectional view in the direction (furnace width direction) orthogonal to a gas flow direction of the duct wall 12, and FIG. 3(*b*) is a cross sectional view taken along the line of the arrows B-B in FIG. 3(*a*).

The structure shown in FIG. 3 is such that one intermediate member 6 is supported with five stud bolts 5B installed at intervals of 420 mm and 560 mm in the furnace width direction on the outer plate 2 of the duct wall 12 and vibration deadening washers 8 are disposed on and under the intermediate member 6 (hereinafter, the structure is called a "periodic structure"). The structure expresses a duct wall 12 of one periodic length PL=2240 mm from the starting point P1 to terminal point P2 of the periodic structure. Therefore, an actual duct wall 12 is provided with four through eight periodic structures in accordance with the size of an HRSG in the furnace width direction.

Also, the respective dimensions of the respective periodic structures, 420 mm and 560 mm, and number of stud bolts 5B are determined with the elongation and strength of the respective components taken into consideration.

In addition, the entire duct wall 12 of the HRSG is constructed with the intermediate members 6 at the ends (that is, starting point P1 and terminal point P2) of two adjacent periodic structures not connected.

The attaching positions of the stud bolts 5B for connecting the outer plate 2 and intermediate member 6 of the duct wall to each other and those of the stud bolts 5A for connecting the inner plate 3 and intermediate member 6 of the duct to each other are shifted in the furnace width direction. In the present embodiment, five stud bolts 5B and four stud bolts 5A are employed in one periodic structure.

With respect to the stud bolts 5B for connecting the outer plate 2 and intermediate member 6 of the duct wall with each other, the interval between the respective stud bolts 5B at both ends in the furnace width direction of one periodic structure and the stud bolts 5B thereinside is made into 420 mm, and the interval of the three stud bolts at the middle portion in the furnace width direction of one periodic structure is made into 560 mm. Since the entire length of one periodic structure in the furnace width direction of the duct wall 12 is 2240 mm, the distance from both ends in the furnace width direction of one periodic structure to the one closest to the middle portion side is 140 mm.

In the example of a supporting structure of the duct wall 12 shown in FIG. 3, the inner plate 3 is a stainless steel plate (SUH409) 9.5 mm thick, the stud bolts 5B are stainless steel (SUS304) bolts threaded with a diameter of 16 mm, and the intermediate member 6 is a stainless steel (SUH409) L-shaped (angular) material 50 mm long×50 mm wide×3 mm thickness.

Figure 4:
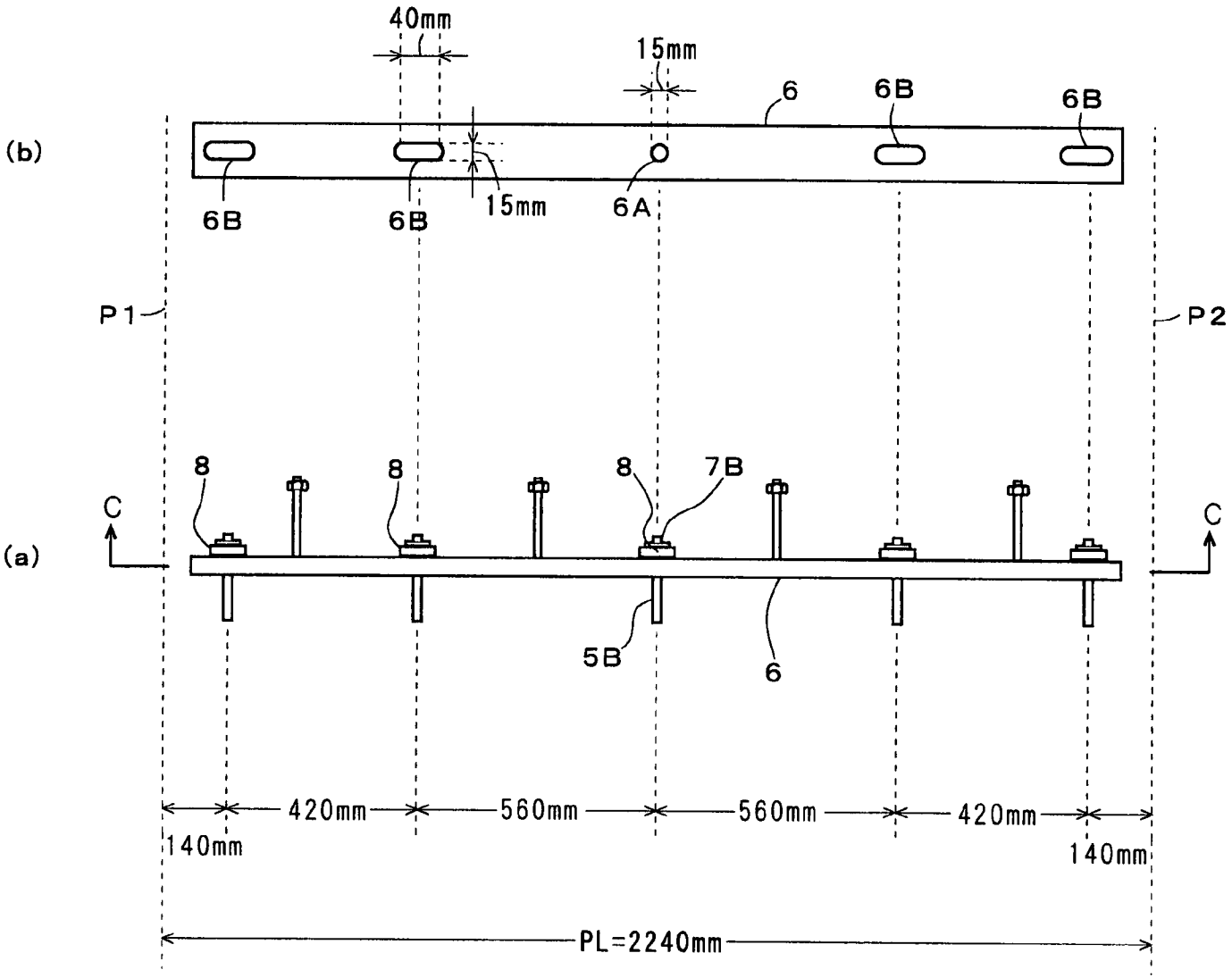
FIG. 4(*a*) is a side elevational view of an intermediate member of a duct wall according to Embodiment 1 of the invention, and FIG. 4(*b*) is a view taken along the line of the arrows C-C in FIG. 4(*a*)

FIG. 4 shows an example of a detailed supporting method of one intermediate member 6 for which five stud bolts 5B of the duct wall 12 shown in FIG. 3 are used. FIG. 4(*a*) shows a sectional view of the intermediate member 6 portion of the duct wall 12, and FIG. 4(*b*) shows a view taken along the line of the arrows C-C in FIG. 4(*a*).

A hole 6A, whose diameter is 15 mm, for fixing the intermediate member is drilled in the middle part of the intermediate member 6, and a stud bolt 5B is passed through the hole 6A, wherein a pair of vibration deadening washers 8 is tightened and fixed by a nut 7B. On the other hand, in addition to the hole 6A for fixing the intermediate member 6, a loose hole 6B composed of a combination of two semi-circles whose diameter is 15 mm and a rectangle whose dimensions are 15 mm×40 mm is provided two by two at both sides of the fixing hole 6A in order to support one intermediate member 6 so as to slide, and the number of the loose holes 6B is four in total. Stud bolts 5B are passed through these loose holes 6B, whereby the vibration deadening washer 8 is supported by the nuts 7B so as to slide therein.

The dimensions of the loose holes 6B of the intermediate member 6 in FIG. 4 are determined with the temperature conditions on the HRSG duct wall 12 taken into consideration. For example, the temperature of the inner surface of the HRSG duct wall 12 in the vicinity of the flow-in portion of a high temperature and high velocity gas 11 shown in FIG. 20 becomes approx. 650° C., and this temperature becomes the maximum temperature in the duct wall 12. However, the dimensions of the loose hole 6B of the intermediate member 6 in FIG. 4 are designed in accordance with the temperature condition which is approx. 650° C. Further, the intermediate member 6 shown in FIG. 4 may be used even for the intermediate members 6 which will be used for lower temperature portions than approx. 650° C., wherein a standardizing design of the intermediate members 6 is enabled.

Figure 5:
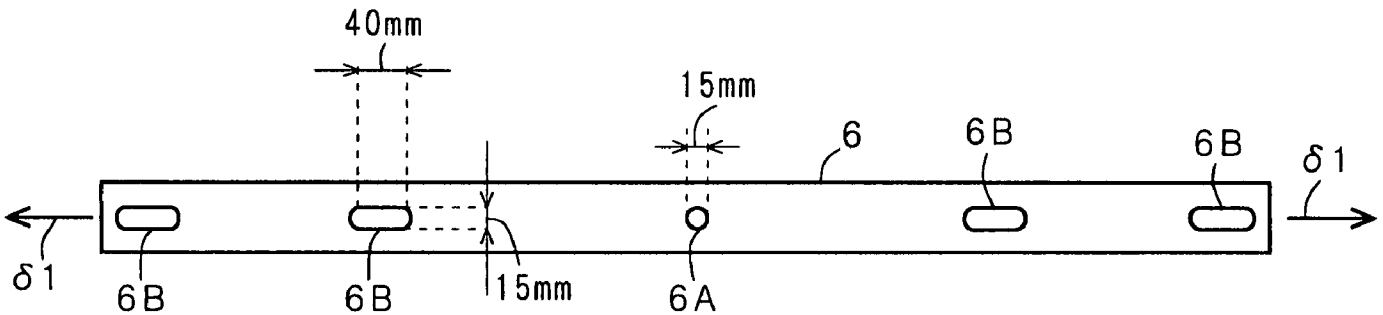
FIG. 5 is a plan view of an intermediate member of a duct wall according to Embodiment 1.

Next, a description is given of the design basis with respect to the position of the hole 6A for fixing the intermediate member 6 shown in FIG. 4. Since the fixing hole 6A is installed at the middle part of the intermediate member 6 of one periodic structure, thermal elongation amounts δ1 at both ends of the intermediate member 6 become the same as shown in a plan view of FIG. 5, which shows the intermediate member 6, wherein it may be sufficient that the dimensions of the loose holes 6B, respectively, installed symmetrically at both sides of the hole 6A for fixing the intermediate member 6 are the same for each other, and a standardizing design of the intermediate member 6 is also enabled.

Figure 6:
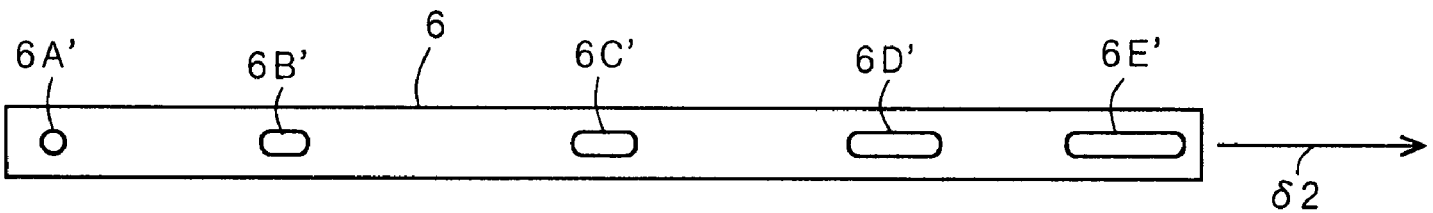
FIG. 6 is a plan view of an intermediate member of a duct wall according to Embodiment 1.

Provisionally, if the hole 6A' for fixing the intermediate member 6 is installed at the upper end side of the intermediate member 6 as shown in FIG. 6, the thermal elongation amount δ2 at the lower end part of the intermediate member 6 is made large although the thermal elongation amount of the intermediate member 6 is zero at the position of the fixing hole 6A'. Therefore, since it becomes necessary to lengthen the loose holes in accordance with the thermal elongation amount at the position in line with an increase in the distance of the loose holes 6B', 6C', 6D' and 6E' from the hole 6A', and mounting at an installation site of the HRSG is made cumbersome, it becomes difficult to standardize the design of the intermediate member 6.

Figure 7:
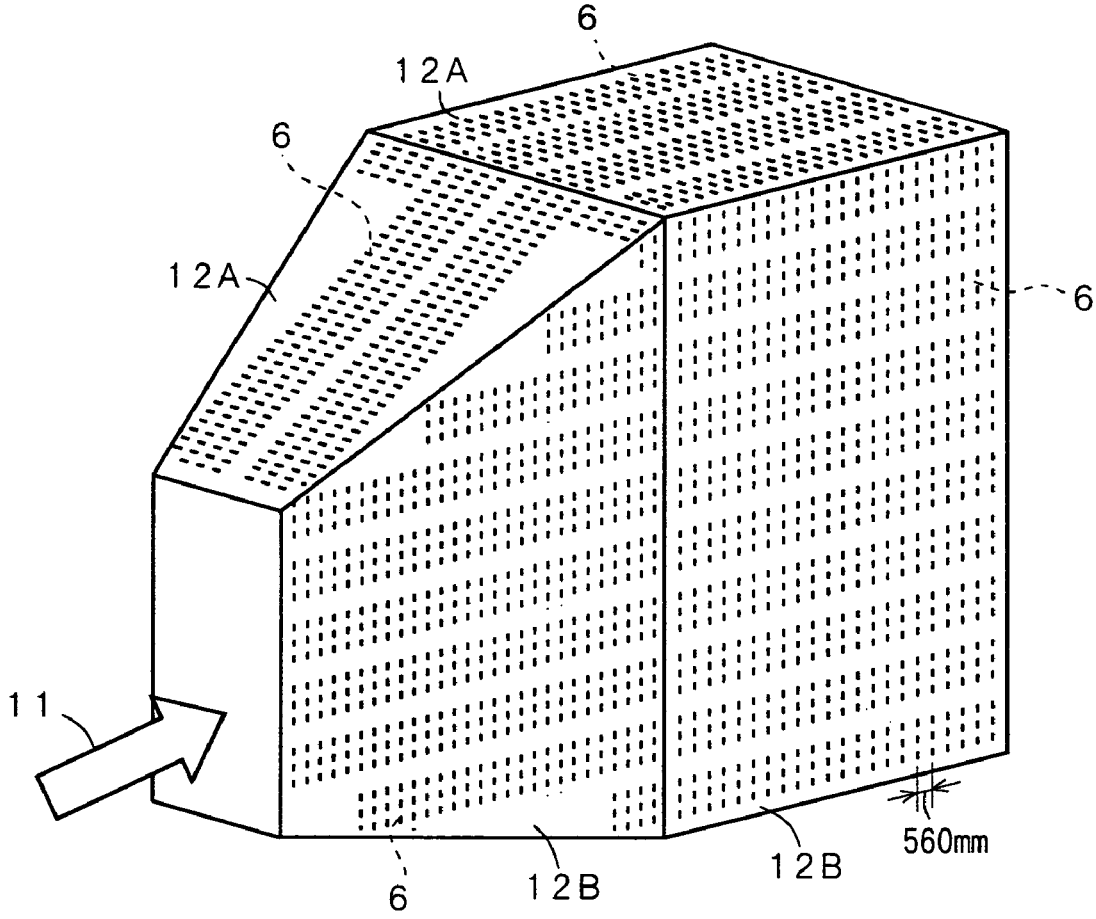
FIG. 7 is a perspective view showing an arrangement example of the intermediate member of a duct wall according to Embodiment 1 of the invention.

FIG. 7 shows a method for installing a standard intermediate member 6 in the entire area of the duct of an HRSG. Usually, self weight of the inner plate 3 of the duct wall 12 and a wind load resulting from a high temperature and high velocity gas 11 are considered as a load operating onto the inner plate 3 of the duct wall 12. However, the self-weight is dominant. Therefore, in order to maintain the strength of the intermediate member 6 with respect to the self weight, the intermediate member 6 is disposed so that the lengthwise direction thereof is turned to the perpendicular direction with respect to the flow direction of a high temperature and high velocity gas lion the entire surface of the upper surface portion 12A, side surface portion 12B and bottom surface (not illustrated) of the duct wall 12. For example, a plurality of intermediate members 6 are disposed perpendicularly to the flow direction of the high temperature gas 11 at intervals of 560 mm.

Thus, where such a structure is employed in which the vibration deadening washer 8 is supported by the intermediate member 6, no large load is given to the entire structure of the duct wall even by thermal elongation of the intermediate member 6, wherein the vibration deadening washer 8 can be supported by the intermediate member 6.

Figure 8:
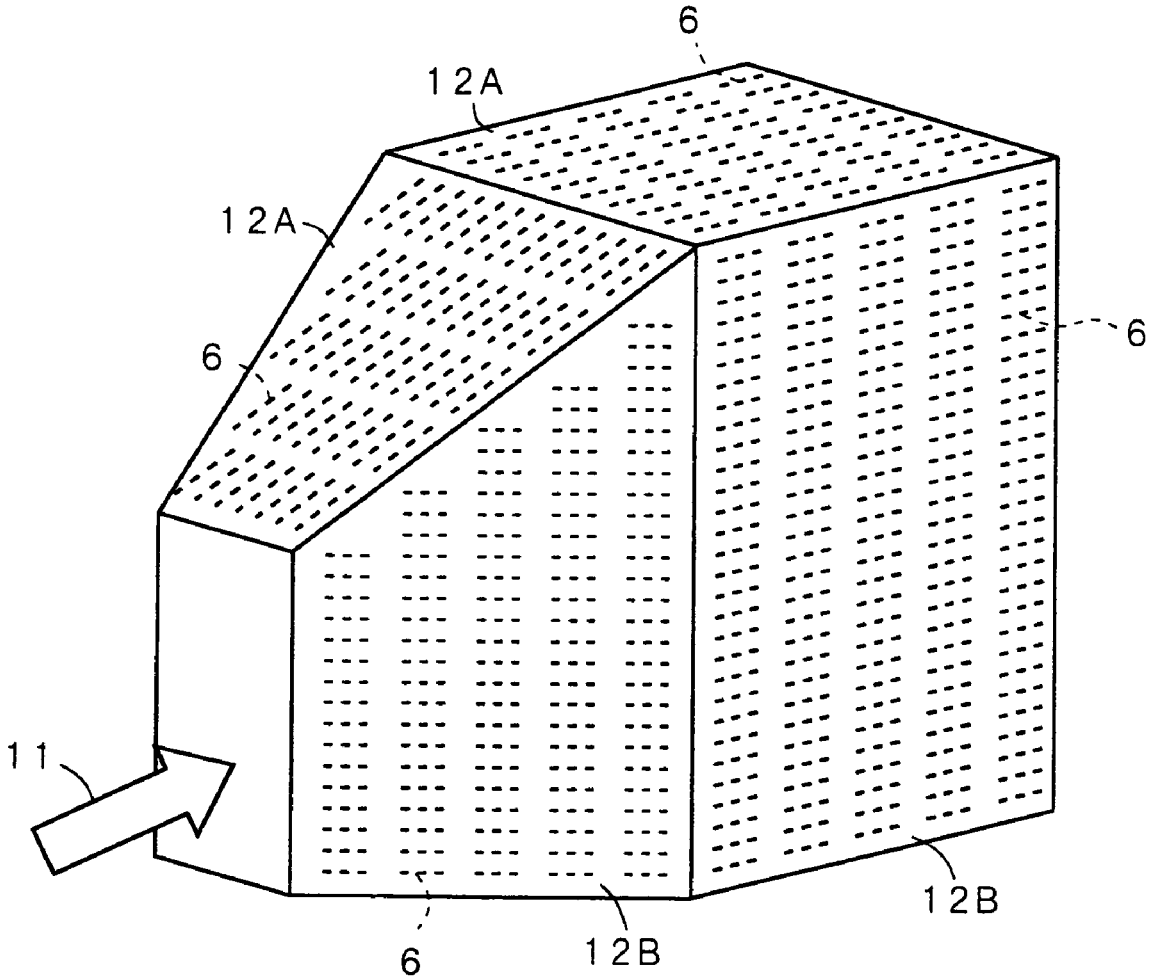
FIG. 8 is a perspective view showing an arrangement example of the intermediate member of a duct wall according to Embodiment 1 of the invention.

On the other hand, usually where a wind load is dominant as a load operating onto the inner plate 3 of the duct, as shown in FIG. 8, the intermediate member 6 is disposed so that the lengthwise direction thereof is turned in the direction along the flow direction of a high temperature gas 11.

Next, a description is given of a structure in which the inner plate 3 of the duct wall 12 is supported by using the intermediate member 6.

An example of the structure in which stud bolts 5A are provided in the intermediate member 6 and the inner plate 3 is supported by these stud bolts 5A is shown in FIG. 3 as a supporting structure of the duct inner plate 3.

With respect to the stud bolts 5A for connecting the duct wall inner plate 3 and the intermediate member 6 to each other, the respective stud bolts 5A at both ends in the furnace width direction of one periodic structure are provided at a position of length 280 mm from the end of one periodic structure, and the intervals between three stud bolts 5A inside thereof are, respectively, 560 mm.

In the supporting structure shown in FIG. 3, the duct wall inner plate 3 is made of a stainless steel (SUH409) plate 3 mm thick, and the stud bolts 5A are stainless steel (SUS304) bolts threaded with a diameter of 14 mm.

Figure 9:
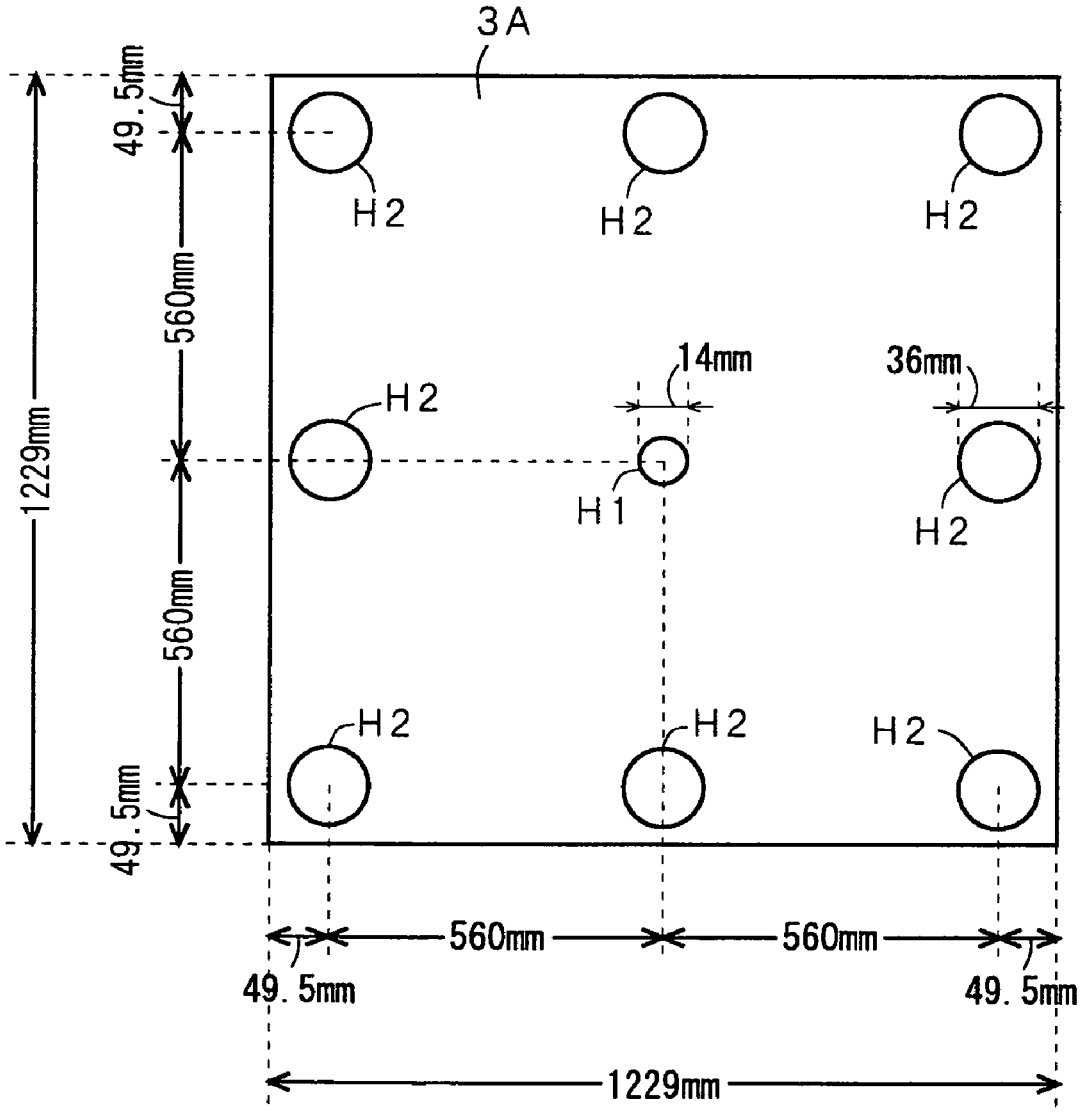
FIG. 9 is a plan view of an inner plate of a duct wall according to Embodiment 1.
Figure 12:
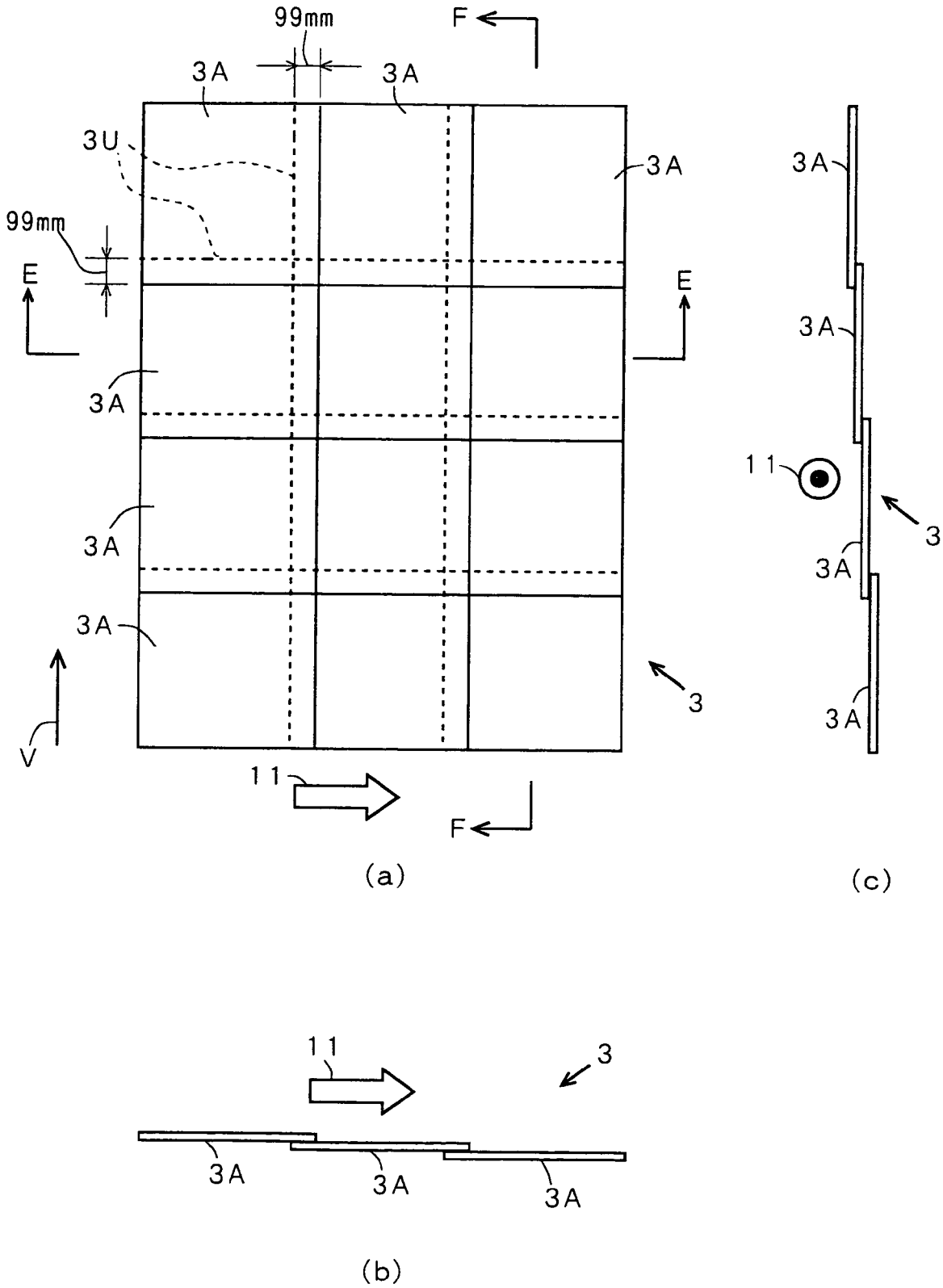
FIG. 12 (*a*) is a plan view in a case where the inner plate of a duct wall according to Embodiment 1 of the invention partially overlaps each other, FIG. 12(*b*) is a view taken along the line of the arrows E-E in FIG. 12(*a*), and FIG. 12(*c*) is a view taken along the line of the arrows F-F in FIG. 12(*a*)

FIG. 9 shows a plan view of the inner plate member 3A which composes the inner plate 3 of the present embodiment. As shown in FIG. 12, the inner plate 3 is such that the entire inner wall surface of an HRSG is composed by a plurality of inner plate members 3A of the same size, which are adjacent to each other and are partially overlapped with each other.

FIG. 9 shows a detailed method for supporting the inner plate members 3A by means of nine stud bolts 5A. The inner plate member 3A is a square plate whose dimensions are, for example, 1229 mm×1229 mm. A hole whose diameter is 14 mm is drilled at the center part of the inner plate member 3A as a hole H1 for fixing the inner plate, whereby the inner plate member 3A is tightened and fixed by the nut 7A with the stud bolt 5A shown in FIG. 3 passed through the fixing hole H1. On the other hand, eight loose holes H2 whose diameter is 36 mm are provided in the surrounding of the fixing hole H1 in the inner plate member 3A in order to support the inner plate member 3A while sliding the same, wherein the stud bolts 5A are passed through these loose holes H2 and the inner plate member 3A is tightened by the nuts 7A so as to be slidably supported.

The dimensions of the loose holes H2 in the inner plate member 3A in FIG. 9 are designed with the temperature conditions in the HRSG duct wall 12 taken into consideration. For example, although the temperature of the inner surface of the duct wall 12 in the vicinity of the flow-in portion of a high temperature and high velocity gas 11 shown in FIG. 20 becomes approx. 650° C. which is the maximum temperature on the duct wall 12, the dimensions of the loose holes H2 of the inner plate member 3A used under such temperature conditions are made into 36 mm in diameter. Also, since the inner plate members 3A shown in FIG. 9 can be used even in a lower temperature part than approx. 650° C., a standardizing design of the inner plate members 3A is enabled.

Figure 10:
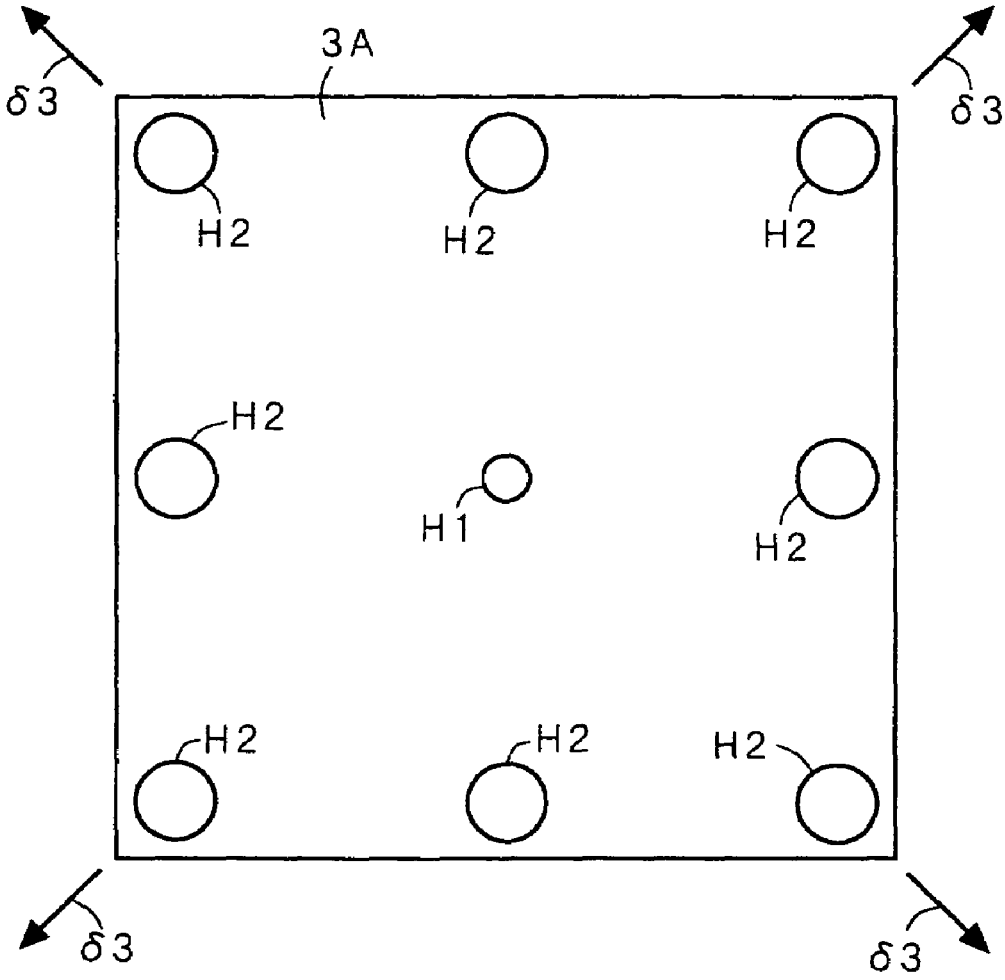
FIG. 10 is a plan view of an inner plate of a duct wall according to Embodiment 1.

Next, a description is given of the design basis regarding the position of the fixing hole H1 of the inner plate members 3A shown in FIG. 9. The fixing hole H1 is provided at the middle part of the inner plate members 3A. With such a construction, the thermal elongation amounts δ3 in four corners of the inner plate members 3A centering around the fixing hole H1 becomes the same for each other as shown in a plan view of the inner plate members 3A which composes the inner plate 3 of FIG. 10, wherein it is sufficient that the dimensions of a plurality of loose holes H2 disposed at the symmetrical position centering around the fixing hole H1 are the same for each other, and a standardizing design of the inner plate member 3A is enabled.

Figure 11:
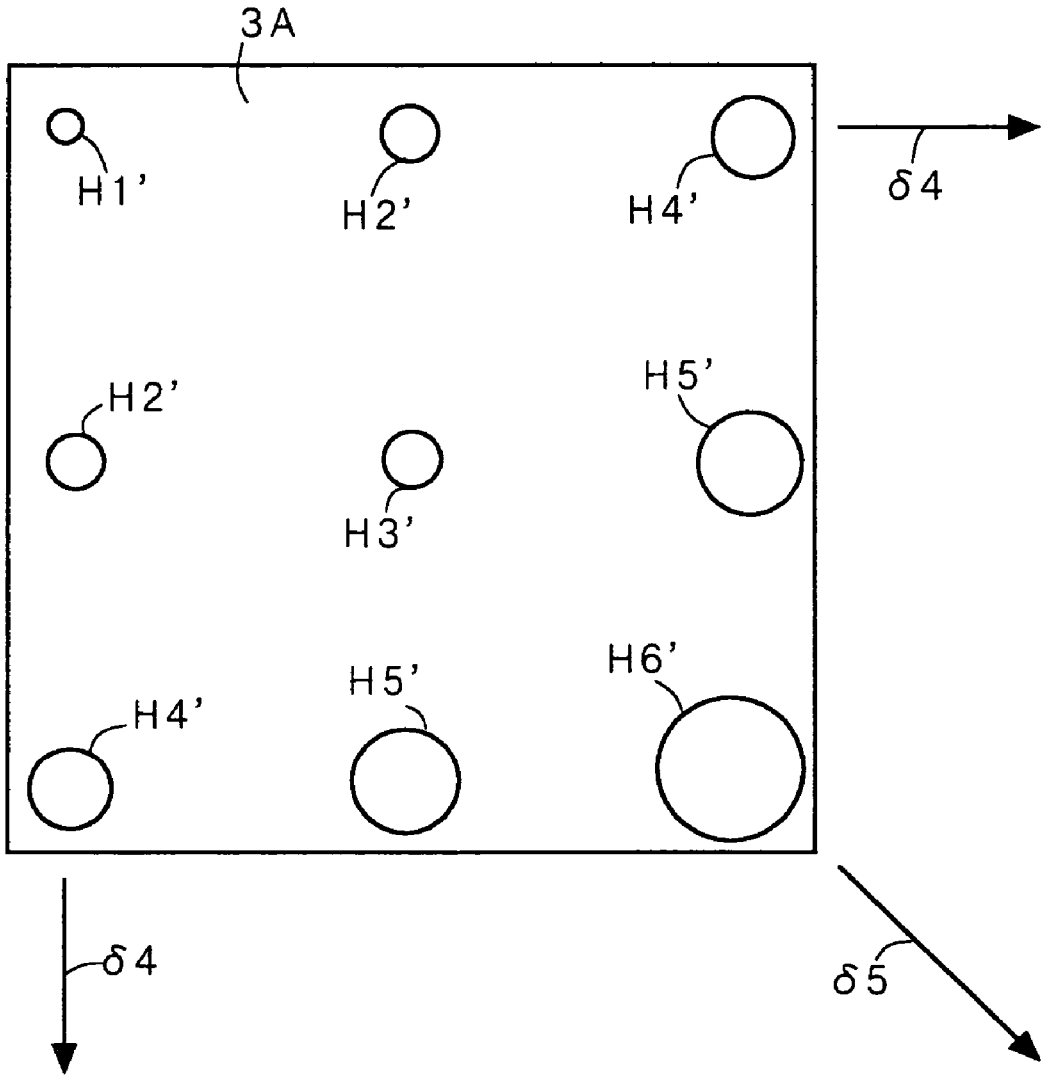
FIG. 11 is a plan view of an inner plate of a duct wall according to Embodiment 1.

Provisionally, as shown in FIG. 11, where the hole H1' for fixing the inner plate member 3A is installed at the upper left end corner on the drawing, although the thermal elongation amount of the inner plate member 3A is zero at the position of the fixing hole H1', the thermal elongation amount δ4 of the inner plate member 3A at the corners of the lower left end and upper right end on the drawing is increased, and the thermal elongation amount δ5 of the inner plate member 3A at the corner portion at the lower right end on the drawing is further increased. Therefore, since it becomes necessary to design the loose holes H2', H3', H4', H5' and H6' in accordance with the thermal elongation amounts of the installation positions, and mounting at the site becomes cumbersome, it becomes difficult to bring about a standardizing design of the inner plate member 3A.

FIG. 12 shows a method for installing a plurality of inner plate members 3A in the entire area of the duct, wherein FIG. 12(*a*) shows a plan view, FIG. 12(*b*) shows a sectional view taken along the line of the arrows E-E in FIG. 12(*a*), and FIG. 12(*c*) shows a sectional view taken along the line F-F in FIG. 12(*a*). In order that a high temperature and high velocity gas 11 flowing in the duct is prevented from flowing into the lower part of the inner plate member 3A, the inner plate member 3A at the upstream side is installed at the upper side of the downstream side inner plate member 3A, and the upper side inner plate member 3A in the perpendicular direction V illustrated is installed at the upper side of the lower side inner plate member 3A in the perpendicular direction V. In addition, an overlapping allowance of two inner plate members 3A to be overlapped with each other is set to, for example, 99 mm. (see also dashed lines 3U illustrating overlapping allowance). If such an inner plate supporting structure is employed, there is no structural problem resulting from thermal elongation, and there is no case where a high temperature and high velocity gas 11 flowing in the duct is rendered to flow into the lower part of the inner plate member 3A.

Figure 13:
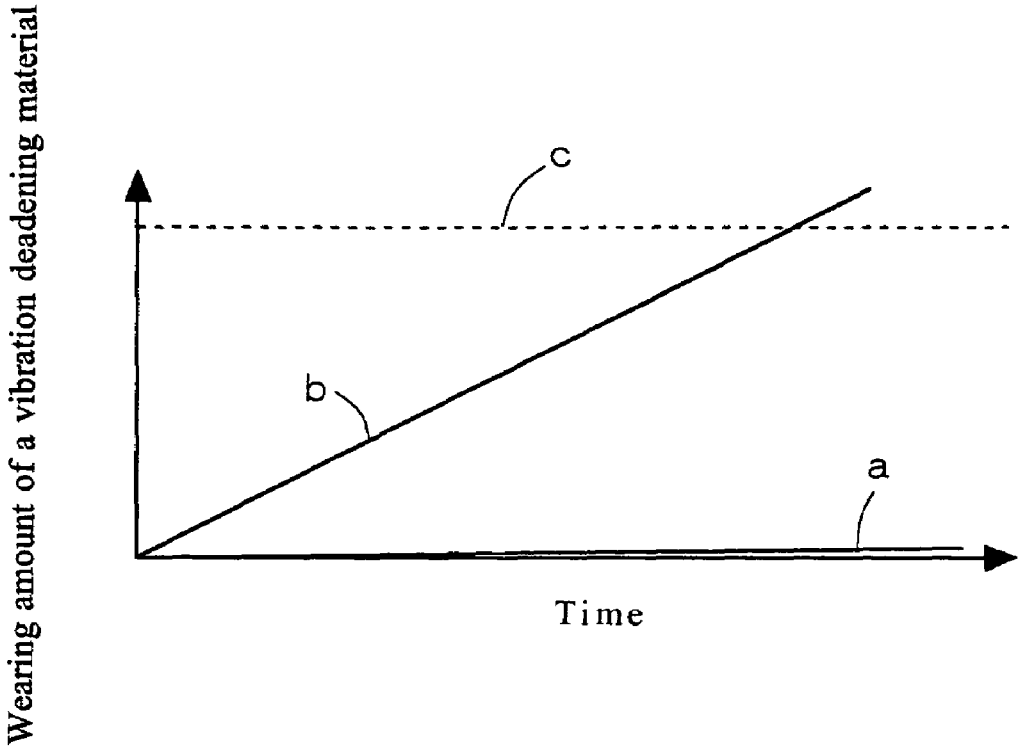
FIG. 13 is a view showing a comparison of the wearing amount of a vibration deadening material of a vibration deadening washer according to Embodiment 1 with that of a vibration deadening material of a vibration deadener inserted type washer according to Embodiment 4.
Figure 17:
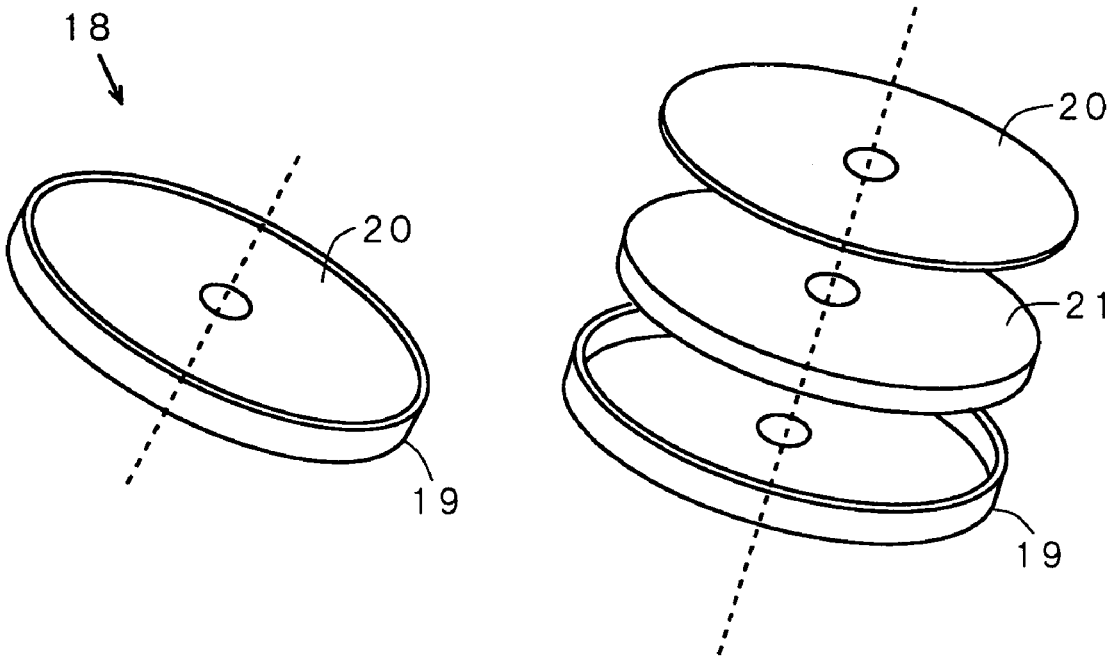
FIG. 17(*a*) is a perspective view showing a vibration deadener inserted type washer according to Embodiments 4 and 5 of the invention and FIG. 17(*b*) is a sectional view thereof.
Figure 17:
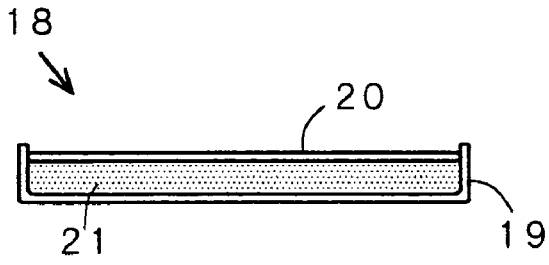
Figure 18:
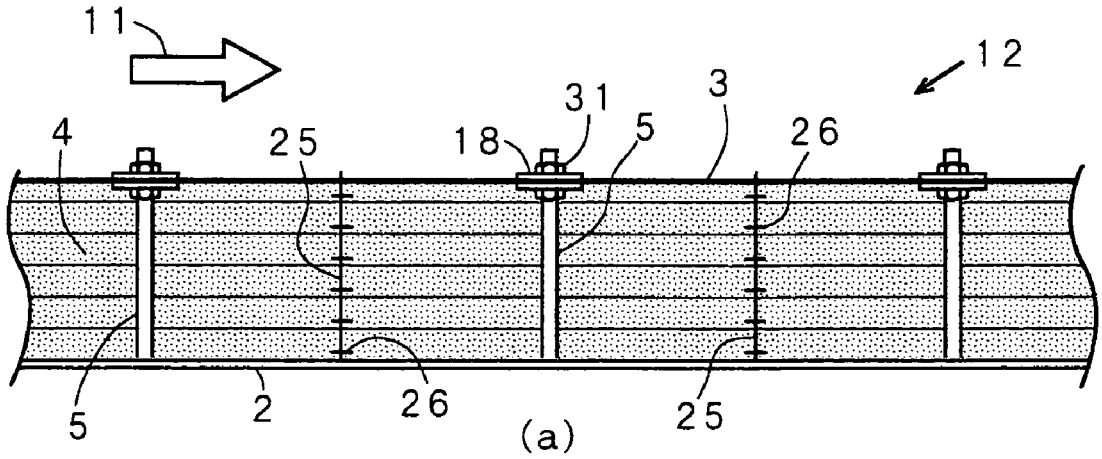
FIG. 18(*a*) is a sectional view of a duct wall in the direction parallel to a gas flow direction of an HRSG in which a vibration deadener inserted type washer according to Embodiment 4 of the invention is used.
Figure 18:
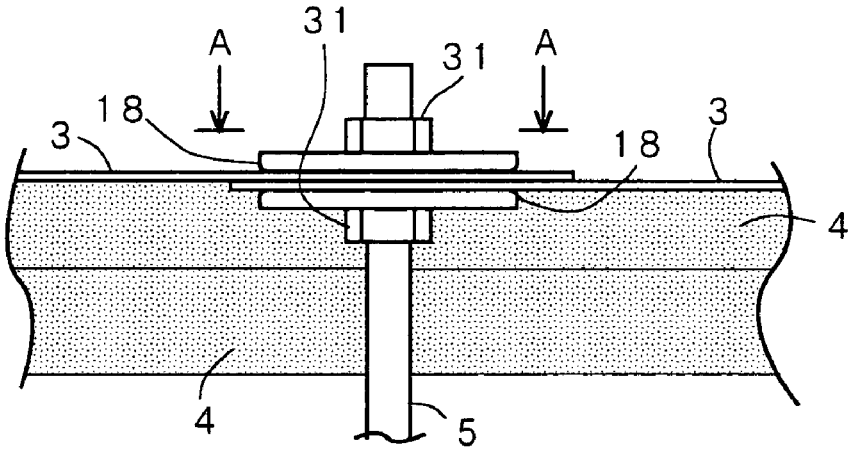
Figure 18:
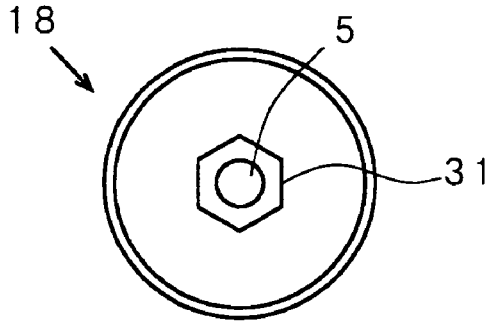

FIG. 13 shows a comparison of a wearing amount b in the case where a vibration deadener inserted type washer 18 shown in FIG. 17 described later is installed at the end part of the stud bolt 5 which is in contact with a high temperature and high velocity gas 11, whose temperature is approx. 650° C. and velocity is approx. 30 meters per second (m/s), at the inner plate 3 side as shown in FIG. 18 with a wearing amount a in the case where a vibration deadening washer 8 shown in FIG. 2 according to the present embodiment is installed at a position being the position almost half the entire thickness of the duct wall 12 shown in FIG. 1, where the temperature is approx. 350 through 400° C. and velocity is zero meters per second (m/s).

In the case where the vibration deadener inserted type washer 18 shown in FIG. 17 is installed at the end part of the stud bolt 5 at the inner plate 3 side which is in contact with a high temperature and high velocity gas 11 shown in FIG. 18, the wearing amount b of the vibration deadener 21 is increased by the influence of the gas 11 in line with elapse of time, and reaches the allowance value c of the wearing amount, wherein the vibration deadening performance is eliminated, and its structural reliability will be lost.

To the contrary, where the vibration deadening washer 8 is installed in the interior of the heat insulating members 4A and 4B according to the present embodiment, the vibration deadening washer 8 is not influenced by the high temperature and high velocity gas 11, and the wearing amount a does not reach the allowance value c, wherein the vibration deadening performance and structural reliability can be maintained for a longer period of time.

Embodiment 2

Figure 14:
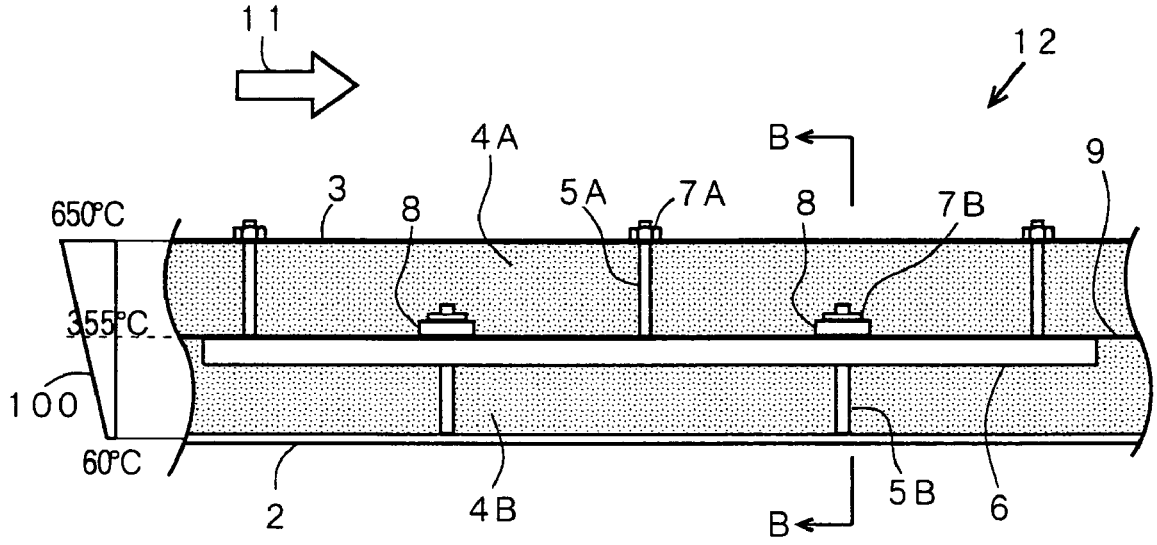
FIG. 14(*a*) is a longitudinal sectional view of a duct wall in the direction parallel to a gas flow direction of an HRSG according to Embodiment 2 of the invention, and FIG. 14(*b*) is a cross sectional view taken along the line of the arrows B-B in FIG. 14(*a*)
Figure 14:
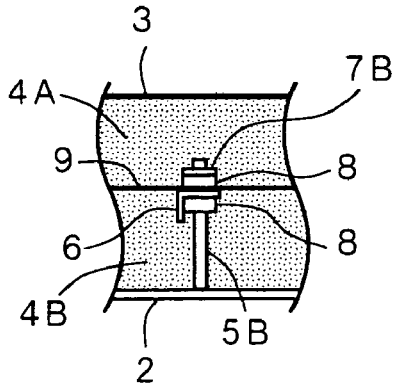

A structure shown in FIG. 14 (FIG. 14(*a*) is a longitudinally sectional view showing the duct wall 12 in a direction parallel to a gas flow direction, and FIG. 14(*b*) is a view taken along the line of the arrows B-B) may be further employed together with the middle plate 9 and intermediate plate 6 in the sectional structure of the duct wall 12 shown in FIG. 1. In this case, the middle plate 9 is disposed so as to overlap the intermediate plate 6 which divides the heat insulating members 4A and 4B, and such a construction is employed, in which a pair of vibration deadening washers 8 shown in FIG. 2, middle plate 9, intermediate plate 6 and stud bolt 5B are tightened by means of a nut 7B.

As in the vibration deadening washer 8 shown in Embodiment 1, the vibration deadening washer 8 according to the present embodiment is installed at a position which is half the entire thickness of the heat insulating members 4A and 4B composed of a material such as a vibration deadener or a vibration dampener, etc., from a high temperature and high velocity gas 11 side flowing in the duct or at the position further outward therefrom.

In a case of using the structure, even if a vibration deadening washer 8 having a vibration deadening material 8*b* available on the market shown in FIG. 2 is used, the vibration deadening washer 8 has sufficient heat resisting performance and wear resisting performance for use. In addition, since the middle plate 9 is employed, the heat rejection effect and soundproofing effect can be further improved, wherein a duct wall 12 having excellent durability can be brought about.

Further, FIG. 14(*a*) also shows temperature distribution 100 between the inner plate 3 of the duct and outer plate 2 thereof.

Embodiment 3

Figure 15:
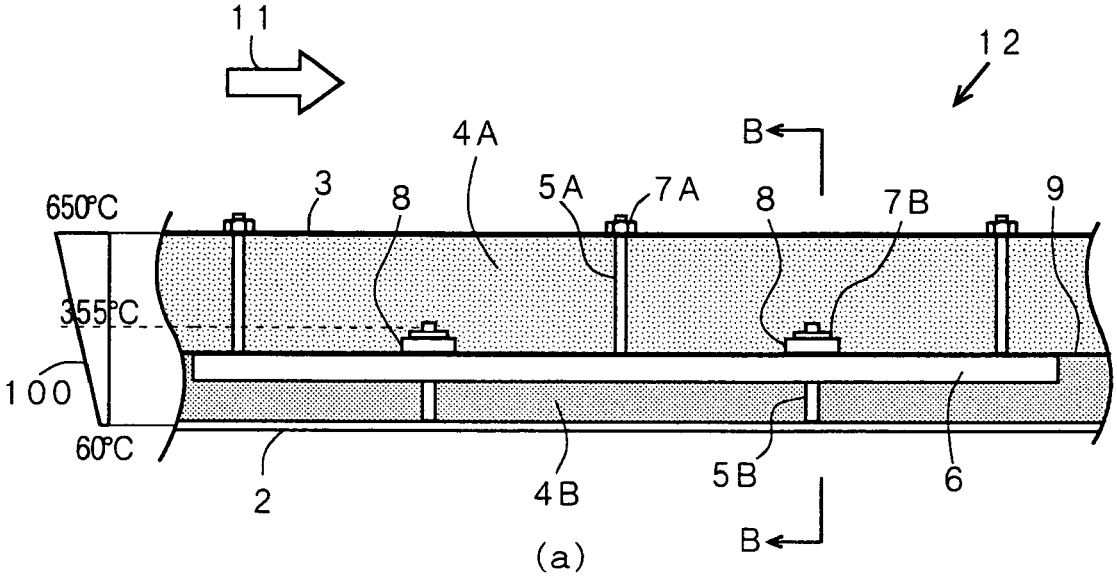
FIG. 15(*a*) is a longitudinal sectional view of a duct wall in the direction parallel to a gas flow direction of an HRSG according to Embodiment 3 of the invention, and FIG. 15(*b*) is a cross sectional view taken along the line of the arrows B-B in FIG. 15(*a*)
Figure 15:
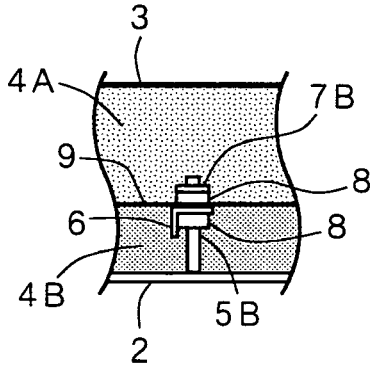

FIG. 15 shows a longitudinally sectional view (FIG. 15(*a*)) of the duct wall 12 according to the present embodiment in a direction parallel to a gas flow direction and shows a view (FIG. 15(*b*)) taken along the line of the arrows B-B in FIG. 15(*a*). The structure shown in FIG. 15 differs from that shown in FIG. 14 in that a heat insulating member 4B of a low temperature portion, which is composed of a vibration deadening material or a vibration dampening material having at least a thickness greater by three or more times than the thickness of the outer plate 2, is installed, and the heat insulating member 4B is compressed at a compression ratio of at least 10% and is supported by the stud bolt 5B and nut 7B between the outer plate 2 and the middle plate 9. All other constructions are identical to those of Embodiment 2. At this time, the intermediate member 6 and middle plate 9 are placed and nipped between a pair of vibration deadening washers 8.

Further, FIG. 15(*a*) shows temperature distribution 100 between the inner plate 3 of the duct and the outer plate 2 thereof. Thus by compressing and supporting the heat insulating member 4B at a compression ratio of 10% or more, adhesion among the outer plate 2, heat insulating member (sound insulating member) 4B, intermediate member 6 and middle plate 9 can be maintained, and no laxation among these components is produced, wherein the vibration deadening performance of the duct wall 12 can be held. Also, since the heat insulating member (sound insulating member) 4B has a thickness greater by three or more times than the thickness of the outer plate 2, bending distortion of the heat insulating member 4B, which is produced by curved vibrations of the outer plate 2, is increased, and sufficient vibration dampening performance can be obtained.

Thus, by adhering the heat insulating member 4B to the outer plate 2, an dampening effect can be improved, and simultaneously the curved vibrations of the duct wall 12 can be suppressed when solid-borne sounds operate.

Further, when compressing and attaching the heat insulating member 4B as described above, the threading length of the stud bolts 5A and 5B is determined and these bolts 5A and 5B are produced in advance with a prescribed compression ratio taken into consideration, whereby working can be easily carried out.

Figure 16:
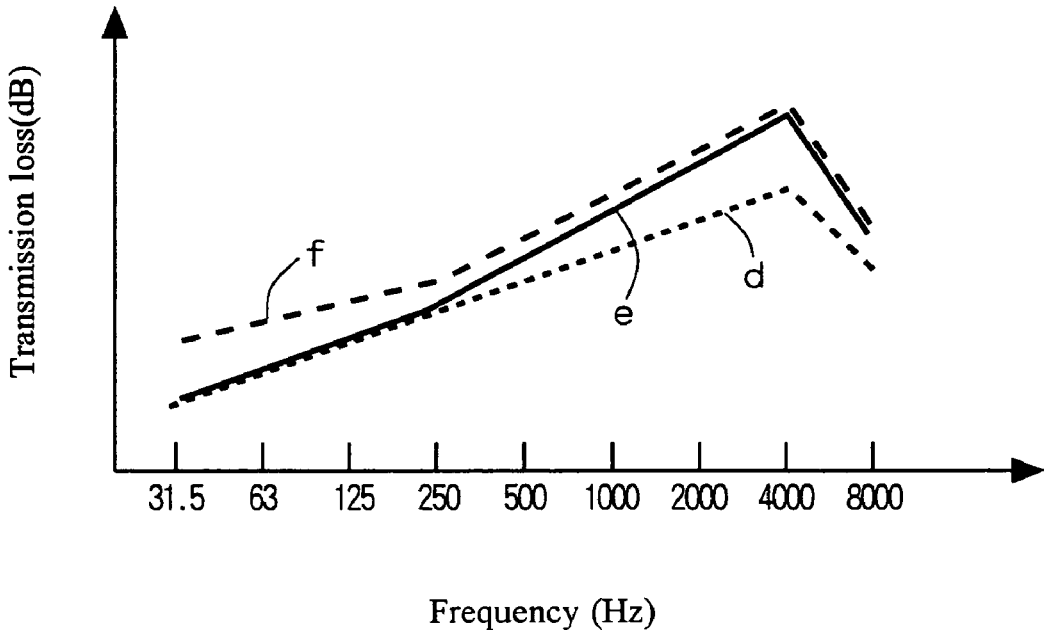
FIG. 16 is a graph showing a transmission loss d in FIG. 23 and FIG. 24 which pertain to prior arts, a transmission loss e of a structure in which a vibration deadening washer is installed in FIG. 14 (Embodiment 2), and a transmission loss f in FIG. 15 (Embodiment 3)
Figure 25:
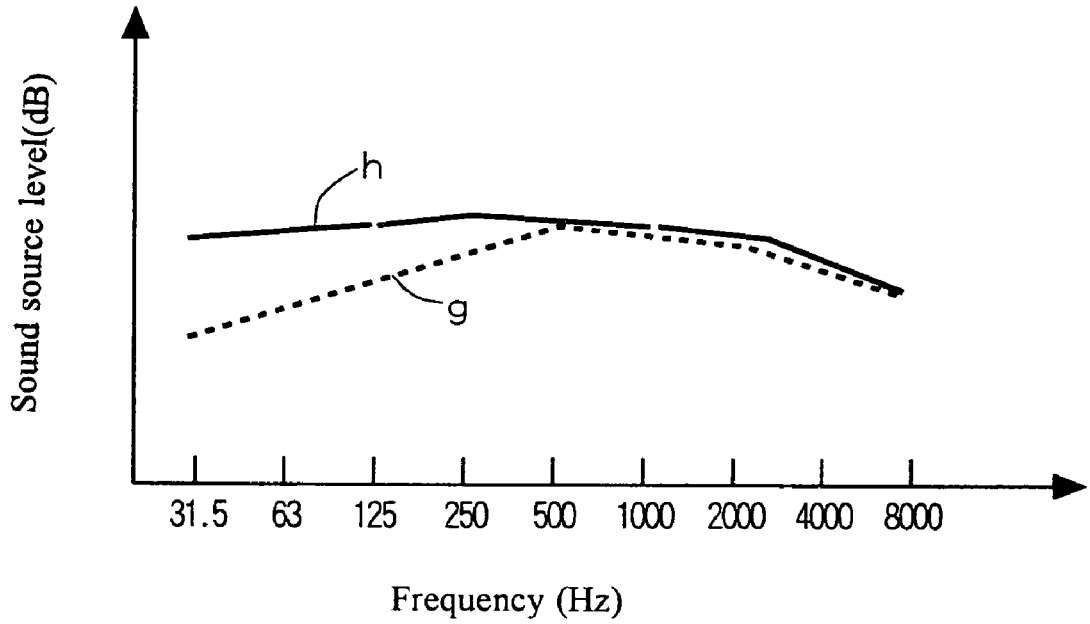
FIG. 25 (Prior Art)
FIG. 25 is a view showing the relationship between a sound source of noise spectra of a combustion turbine and a frequency thereof.

A description is given of performance of the vibration deadening washer 8 according to Embodiment 3 using FIG. 16 and FIG. 25.

As shown in FIG. 25, with respect to turbine spectra h for HRSG ducts, noise is large in a low frequency zone which is 250 Hz or less, and as described above, this is a great factor in the HRSG duct sound insulation.

Figure 23:
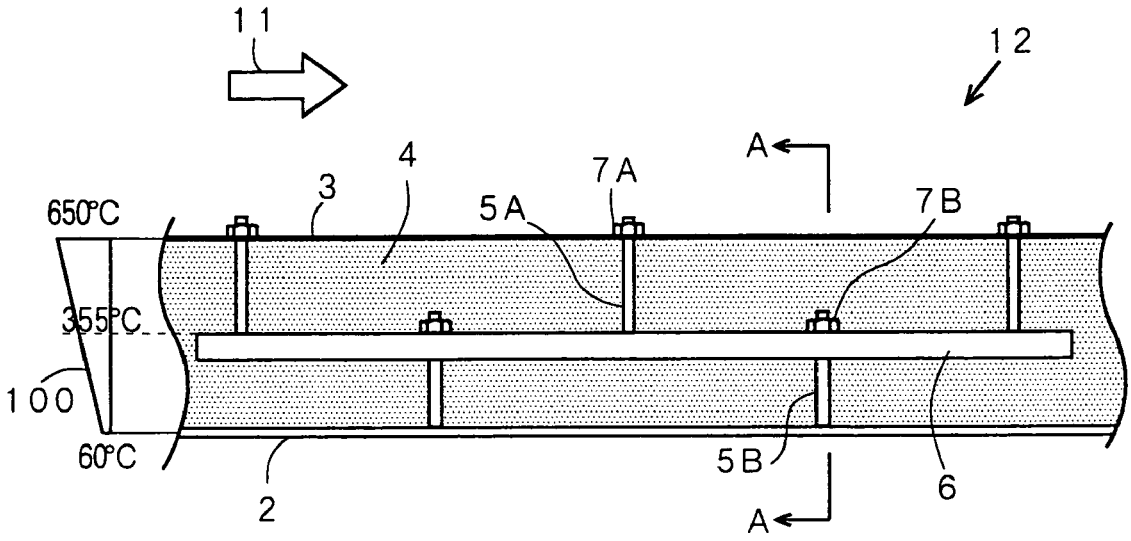
FIG. 23 (Prior Art)
FIG. 23(*a*) is a sectional view of a duct wall in the direction parallel to a gas flow direction of an HRSG according to a prior art, and FIG. 23(*b*) is a view taken along the line of the arrows A-A.
Figure 23:
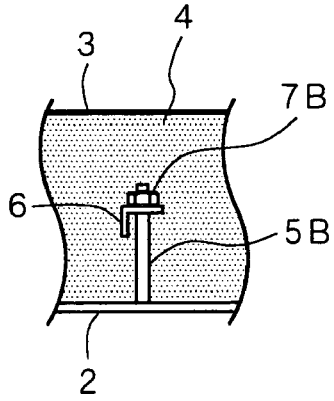
FIG. 23 (Prior Art)
Figure 24:
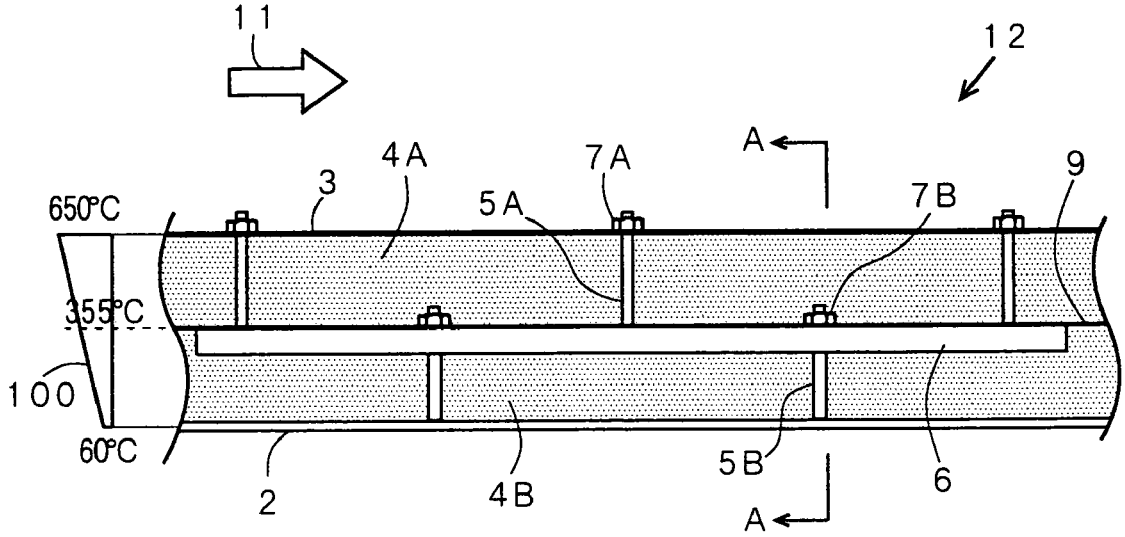
FIG. 24 (Prior Art)
FIG. 24(*a*) is a sectional view of a duct wall in the direction parallel to a gas flow direction of an HRSG according to a prior art, and FIG. 24(*b*) is a view taken along the line of the arrows A-A in FIG. 24(*a*)
Figure 24:
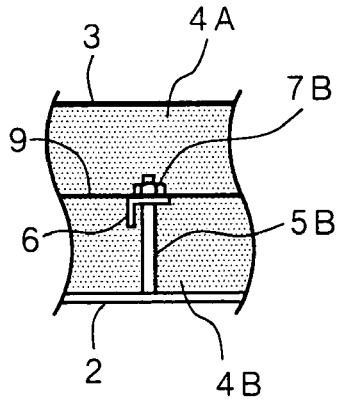
FIG. 24 (Prior Art)

First, FIG. 16 shows a transmission loss d in a duct wall structure according to a prior art, which is not provided with any vibration deadening washer 8 (FIG. 2), shown in FIG. 23 and FIG. 24.

FIG. 16 shows the relationship between frequencies of the above-described transmission loss d (prior art), transmission loss e (Embodiment 2) of the duct wall 12 shown in FIG. 14, and transmission loss f (Embodiment 3) of the duct wall 12 shown in FIG. 15, and the transmission loss of sounds (dB).

As shown in FIG. 16, the transmission loss d of the duct wall shown in FIG. 23 and FIG. 24, which is a prior art, is lower than the transmission loss e (Embodiment 2) of the duct wall 12 in which a vibration deadening washer 8 shown in FIG. 14 is installed, and the transmission loss f (Embodiment 3) of the duct wall 12 in which a vibration deadening washer 8 shown in FIG. 15 is installed and the heat insulating member 4B of a lower temperature portion is compressed.

The transmission loss e of Embodiment 2 in which the vibration deadening washer 8 shown in FIG. 14 is installed is further improved than the transmission loss d of the prior art, and the transmission loss f of Embodiment 3 shown in FIG. 15 can improve the transmission loss at a low frequency zone of 250 Hz or less, which has not been solved by any prior art.

If a duct structure according to the above-described embodiments 1 through 3 is employed, durability and soundproofing performance of the duct wall 12 can be maintained in a satisfactory state free from any wearing problem in the vibration deadening washers 8, wherein a duct structure having high reliability can be proposed.

Embodiment 4

In the present embodiment, a vibration deadener inserted type washer 18 composed of a construction shown in a perspective view of FIG. 17(*a*) and a sectional view of FIG. 17(*b*) is employed as a vibration deadening washer applied to an area, in which a high temperature and high velocity gas 11 flows, in the interior of the duct wall 12 of an HRSG.

The vibration deadener inserted type washer 18 employs a construction in which a vibration deadener 21 is placed and nipped between a tray-shaped pan 19 worked to be tray-shaped and an upper cover disk 20 matched with the inner diameter of the pan 19. Such a construction of a vibration deadener inserted type washer 18 as shown in FIG. 17 is shown aiming at such adverse conditions in which the washer 18 is exposed to conditions of high temperature of approx. 650° C. and high velocity of approx. 30 meters per second (m/s) by influences of a high temperature and high velocity gas 11 flowing in the HRSG.

FIG. 18 shows a structure of a duct wall 12 of the HRSG according to the present embodiment using the vibration deadener inserted type washer 18. FIG. 18(*a*) shows a sectional view of the duct wall 12 in the direction parallel to a gas flow direction, FIG. 18(*b*) shows a partially enlarged view of FIG. 18(*a*), and FIG. 18(*c*) shows a view taken along the line of the arrows A-A in FIG. 18(*b*).

Since a high temperature and high velocity gas 11 whose temperature is approx. 650° C. enters between the cover disk 20 of the vibration deadener inserted type washer 18 and the tray-shaped pan 19 thereof, a problem of wearing occurs in the vibration deadener 21. Therefore, rock fibers, ceramic fibers, glass fibers, and a metal-based fibrous substance etc., are used since a material having excellent vibration deadening performance such as vibration insulating rubber is not used as the vibration deadener 21.

Further, the present washer 18 has a soundproofing effect only with respect to middle through high frequency zones, the frequency of which is 250 Hz or more. The soundproofing effect thereof is not comparatively satisfactory in a case where the noise level in the other low frequency zones is high.

Figure 20:
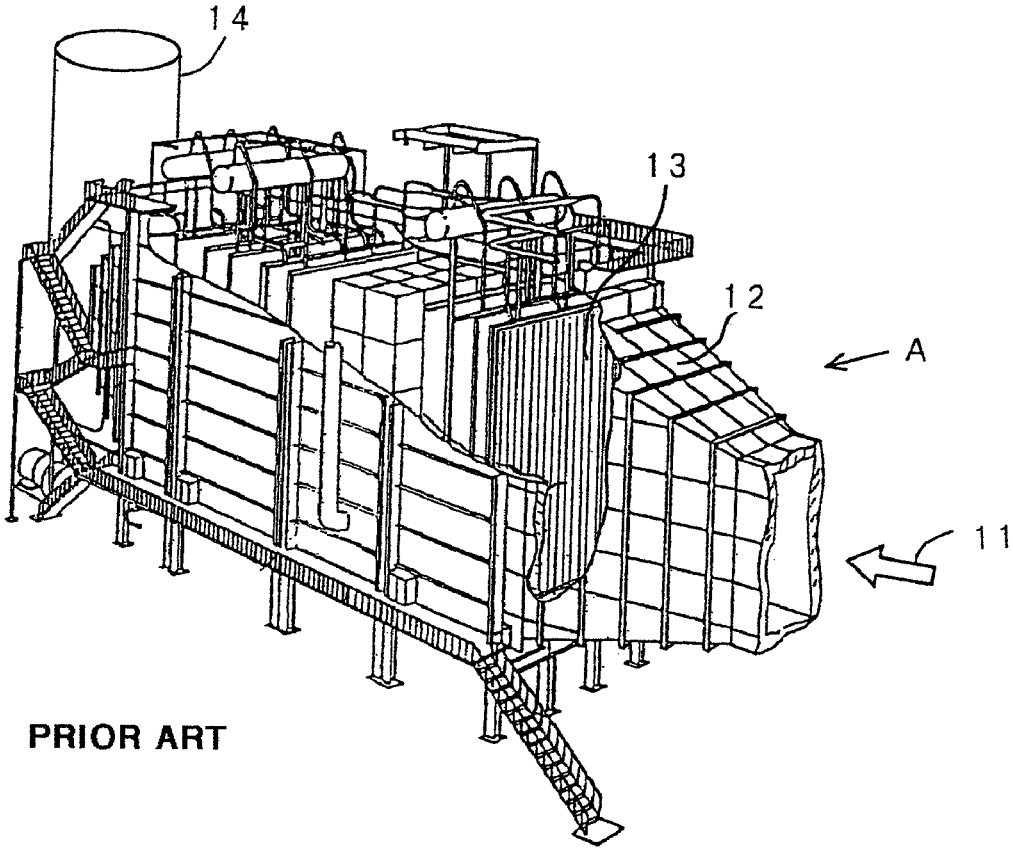
FIG. 20 is a perspective view of the entirety of an HRSG.
Figure 21:
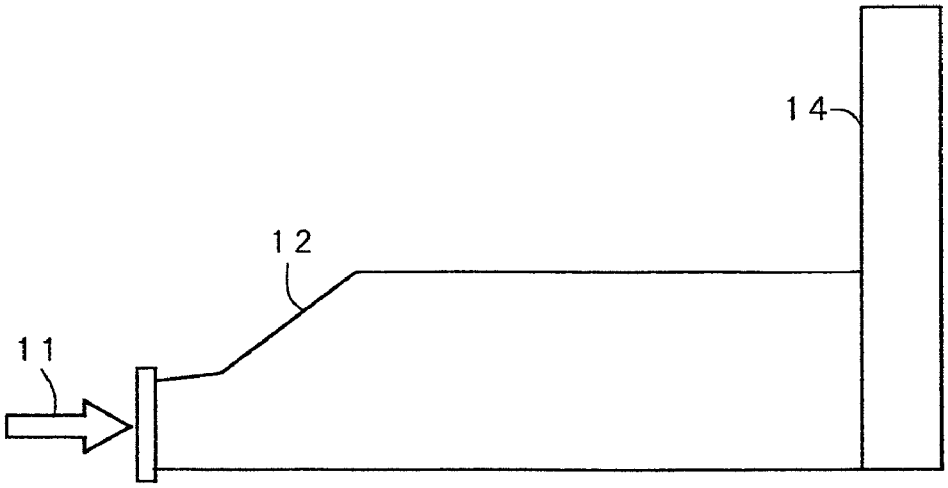
PRIOR ART FIG. 21
FIG. 21 is a view taken in the direction of the arrow A in FIG. 20.

Therefore, it is recommended that the vibration deadener inserted type washer 18 is installed in a gas flow channel located at a comparatively low temperature area (whose temperature is 600° C. through 400° C.) of the duct wall 12 of the HRSG shown in FIG. 20.

As shown in FIG. 18, a plurality of heat insulating members 4 are disposed to be laminated to each other between the outer plate 2 of the duct wall 12 and the inner plate 3 inside the duct. The outer plate 2 and inner plate 3 are retained by stud bolts 5 and insulation pins 25 having a function by which the heat insulating members 4 are fixed. A pair of vibration deadener inserted type washers 18 and 18 and nuts 31 and 31 are provided at the inner plate 3 side of the stud bolts 5 whose end parts are supported on the outer plate 2. Then, the inner plate 3 is mounted, and speed washers 26 are disposed in respective layers of the heat insulating members 4 of the insulation pins 25 to fix the respective heat insulating members 4.

As shown in FIG. 18, the vibration deadener inserted type washer 18 is mounted instead of a disk-shaped washer 36 (Refer to FIG. 22), having a standard heat insulating structure, of the duct wall 12 of a conventional HRSG, thereby reducing solid-borne sounds on the basis of an dampening effect of sound (vibration) by the vibration deadener 21. Features of the vibration deadener inserted type washer 18, which are other than the soundproofing effect, are described below.

1) Since the vibration deadener inserted type washer 18 functions as a washer, the number of components is not increased.

2) Since the vibration deadener 21 used for the vibration deadener inserted type washer 18 is not exposed directly to a gas 11, there is no fear of the vibration deadener 21 to be scattered out.

3) A pair of vibration deadener inserted type washers 18 between which the inner plate 3 is placed and nipped has such a structure by which it can withstand a shearing force generated in the sections thereof by frictional resistance resulting from elongation of the inner plate 3 due to changes in the internal temperature when starting and stopping a plant.

In addition, a soundproofing effect of the vibration deadener inserted type washer 18 shown in FIG. 18 can be provided in a middle through high frequency zone whose frequency is 250 Hz or more in the graph shown in FIG. 25, and the soundproofing effect cannot be expected in turbine sound source spectra h in which sound or noise of a low frequency zone whose frequency is less than 250 Hz is large.

Using the duct structure according to the above-described embodiment 4, although the duct wall structure in which vibration deadener inserted type washers 18 are employed is inferior in durability to a case where the vibration deadening washers 8 are incorporated in the interior of the duct wall, the soundproofing effect of the duct wall 12 can be maintained in a satisfactory state for a comparatively long period of time, and a duct structure having high reliability can be proposed.

Embodiment 5

Figure 19:
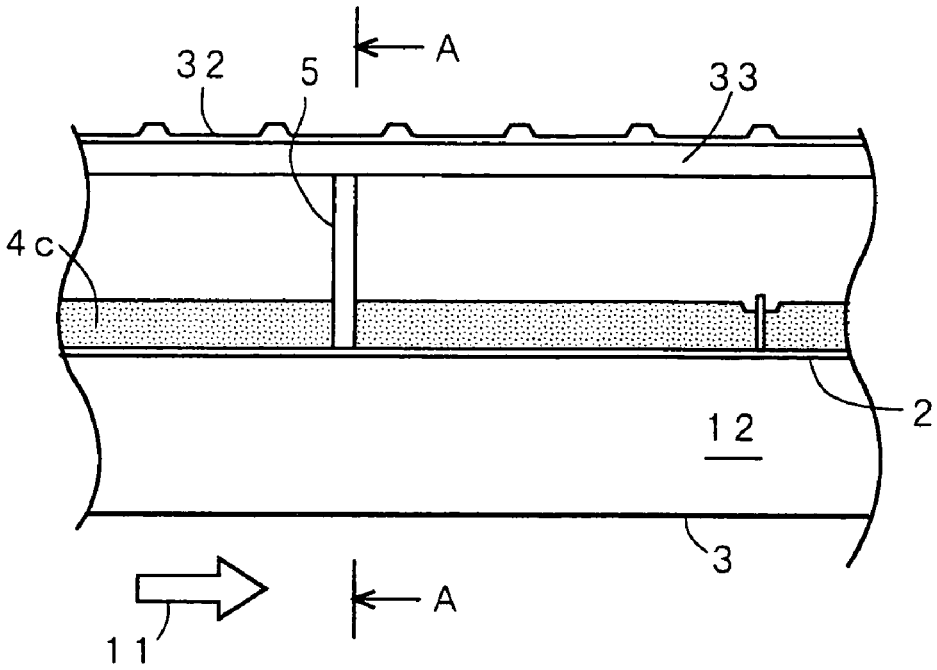
FIG. 19(*a*) is a sectional view of a duct wall in the direction parallel to a gas flow direction of an HRSG, in which a vibration deadener inserted type washer, according to Embodiment 5 of the invention is used.
Figure 19:
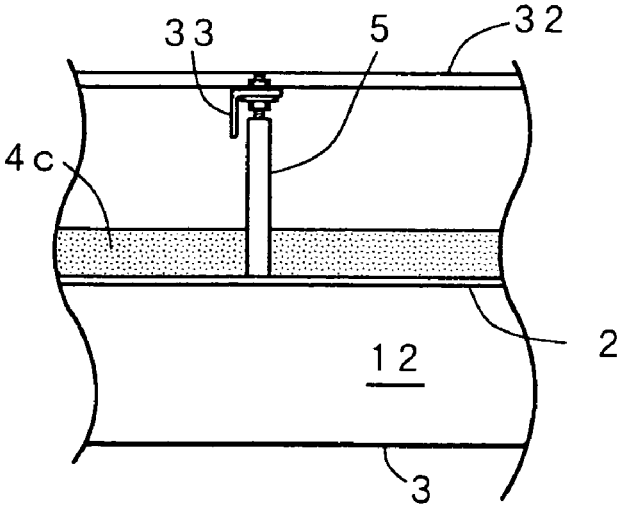
Figure 19:
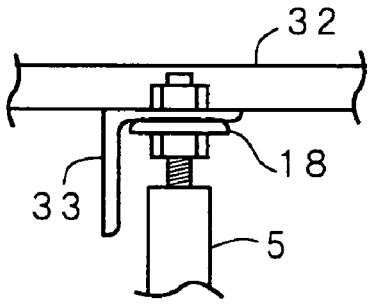

In the above-described embodiment 4, a description was given of a case where vibration deadener inserted type washers 18 shown in FIG. 17 are applied to a heat insulating structure inside the outer plate 2 of the duct wall 12. However, FIG. 19(*a*) shows a longitudinally sectional view of the duct wall 12 of an HRSG in the direction parallel to a gas flow direction, in which vibration deadener inserted type washers 18 according to present embodiment are used, FIG. 19(*b*) shows a view taken along the line of the arrows A-A in FIG. 19(*a*), and FIG. 19(*c*) is a partially enlarged view of FIG. 19(*b*).

Figure 22:
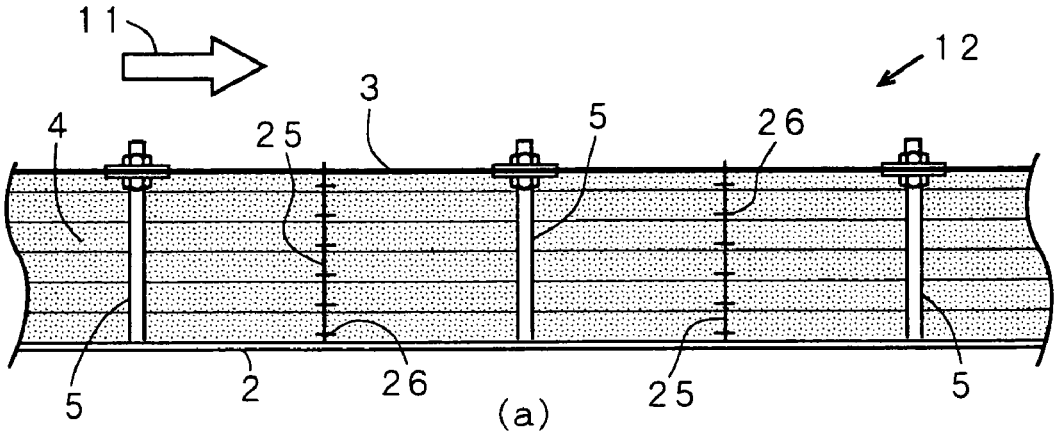
FIG. 22 (Prior Art)
FIG. 22(*a*) is a sectional view of a duct wall in the direction parallel to a gas flow direction of a prior art HRSG, and FIG. 22(*b*) is a partially enlarged view of FIG. 22(*a*)
Figure 22:
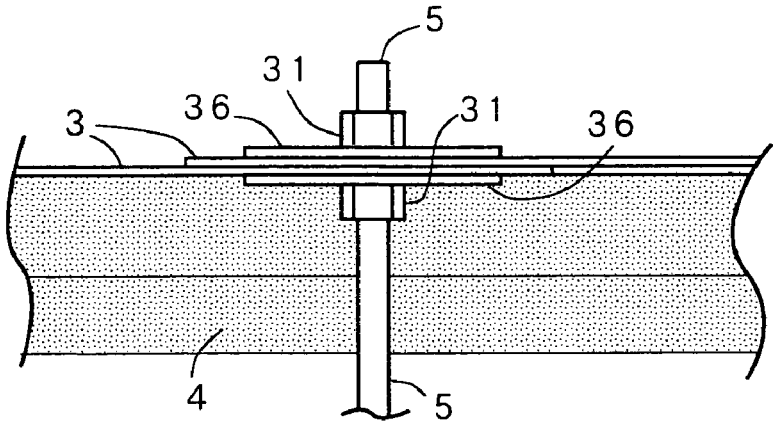
FIG. 22 (Prior Art)

The duct walls 12 described in the above-described embodiments 1 through 4 or duct walls 12, shown in FIG. 22 through FIG. 24, according to the prior arts may be used as a duct wall 12 according to the present embodiment. A heat insulating member 4C (composed of the same material as that of the heat insulating members 4A and 4B) are further adhered to the outside (that is, the atmospheric side) of the outer plate 2 of the corresponding duct wall 12, and the duct wall 12 according to the present embodiment may be applicable to the stud bolts 5 attached to the outer plate 2 and the external heat insulating structure composed of a supporting angle 33 and an outer casing 32. That is, the vibration deadener inserted type washers 18 may be used as a vibration deadening material between the supporting angle 33 and the outer plate 2.

In this case, the vibration deadener inserted type washers 18 are able to effectively prevent solid-borne vibrations from leaking outward of the duct wall 12.

The transmission loss was measured with the vibration deadener inserted type washers 18 incorporated in a test body which is simulated to be an HRSG wall surface. According to the results thereof, it was confirmed that the soundproofing performance was improved by 5 dB on average in the middle through high frequency zones in comparison with the prior art structure.

The duct structure according to present embodiment is able to offer a duct structure having high reliability, by which the soundproofing performance of the duct wall 12 can be maintained in a satisfactory state for a comparatively long period of time.

Also, in Embodiments 2 through 5, such an inner plate 3 may be constructed, which composes the entirety of the inner wall surface of an HRSG by causing two inner plate members 3A adjacent to each other to be partially overlapped with each other as shown in FIG. 12.

INDUSTRIAL APPLICABILITY

A duct wall structure according to the invention can be used as a duct structure for an HRSG in which a high temperature gas flows in the interior of a duct, wherein a countermeasure against thermal elongation of the supporting structure of vibration deadening washers can be secured, and the soundproofing performance of the duct can be maintained in a satisfactory state. Furthermore, a duct structure having high reliability can be maintained for a longer period of time.

In addition, the duct wall structure according to the invention is applicable not only to the duct wall structure of ducts, etc., in which a high temperature and high velocity gas exhausted from a thermal system such as a gas turbine flows but also to a duct wall structure for heat insulation and sound insulation of an air transfer duct such as air and combustion gas used in various types of industrial plants, combustion plants, power generation plants, etc.

What is claimed is:

1. A heat insulating and sound insulating duct wall structure comprising a gas flow channel, the duct wall structure comprising:

an inner plate at a gas flow side;

an outer plate at an atmospheric side;

at least one intermediate member having a lengthwise direction disposed in parallel to the inner plate and outer plate in an intermediate portion between the inner plate and the outer plate;

a plurality of first supporting members both ends of which are, respectively, fixed at the inner plate and intermediate member in order to retain the spacing between the inner plate and the intermediate member;

a plurality of second supporting members both ends of which are, respectively, fixed at the outer plate and intermediate member in order to retain the spacing between the outer plate and the intermediate member;

a vibration deadening washer attached to a connection portion at the intermediate member side of the second supporting members, wherein the attaching position of the vibration deadening washer is provided in an area in a duct wall having a temperature of 400° C. or less; and a heat insulating member filled in a clearance between the intermediate member, the first and second supporting members and the vibration deadening washer between the inner plate and the outer plate.

2. The heat insulating and sound insulating duct wall structure according to claim 1, wherein the vibration deadening washer is provided at half the entire thickness of the heat insulating member filled between the inner plate and the outer plate or at the outer plate side position from the half thereof.

3. The heat insulating and sound insulating duct wall structure according to claim 2, wherein a heat insulating member filled between the intermediate member and the outer plate comprises a vibration deadening material or a vibration dampening material having a thickness which is greater by at least three times than the thickness of the outer plate, and is adhered to the outer plate in a state where the heat insulating member is compressed at a compression ratio of at least 10% of the entire thickness thereof.

4. The heat insulating and sound insulating duct wall structure according to claim 1, wherein a plurality of holes through which the second supporting members are passed are provided in the intermediate member in the lengthwise direction of the intermediate member.

5. The heat insulating and sound insulating duct wall structure according to claim 4, wherein a plurality of holes through which the second supporting member secured at the intermediate member are passed comprises a hole for fixing the vibration deadening washer disposed at the middle part in the lengthwise direction of the intermediate member and at least one set of loose holes disposed at the symmetrical positions of the intermediate member in the lengthwise direction thereof centering around the corresponding fixing hole.

6. The heat insulating and sound insulating duct wall structure according to claims 1, wherein a plurality of intermediate members are, respectively, disposed in both the gas flowing direction and the direction orthogonal thereto with the lengthwise direction thereof orthogonal to the gas flowing direction.

7. The heat insulating and sound insulating duct wall structure according to claim 1, wherein a plurality of intermediate members are, respectively, disposed in both the gas flowing direction and the direction parallel thereto with the lengthwise direction thereof parallel to the gas flowing direction.

8. The heat insulating and sound insulating duct wall structure according to claim 1, wherein the inner plate is comprises a plurality of inner plate members laminated to each other, and the respective inner plate members are provided with a plurality of holes through which the first supporting member is passed.

9. The heat insulating and sound insulating duct wall structure according to claim 8, wherein a plurality of holes through which the first supporting member secured in the respective inner plate members are provided with a hole for fixing the vibration deadening washer disposed at the middle part of the inner plate member and at least one set of loose holes disposed at symmetrical positions of the inner plate members centering around the corresponding fixing hole.

10. The heat insulating and sound insulating duct wall structure according to claim 8, wherein the respective inner plate members are disposed so as to partially overlap with the inner plate member adjacent thereto, the inner plate member at the upstream side of a gas flow is installed on the inner plate member at the downstream side thereof, and the inner plate member at the upper side in the perpendicular direction is installed on the inner plate member at the lower side in the perpendicular direction.

11. The heat insulating and sound insulating duct wall structure according to claim 1, wherein a middle plate for bifurcating the heat insulating member is provided at the attaching position of the intermediate member along the lengthwise direction of the inner plate and outer plate.

12. A heat insulating and sound insulating duct wall structure comprising a gas flow channel, the duct wall structure comprising:

an inner plate at a gas flow side;

an outer plate at an atmospheric side;

at least one intermediate member having a lengthwise direction disposed in parallel to the inner plate and outer plate in an intermediate portion between the inner plate and the outer plate;

a plurality of first supporting members both ends of which are, respectively, fixed at the inner plate and intermediate member in order to retain the spacing between the inner plate and the intermediate member;

a plurality of second supporting members both ends of which are, respectively, fixed at the outer plate and intermediate member in order to retain the spacing between the outer plate and the intermediate member;

a vibration deadening washer attached to a connection portion at the intermediate member side of the second supporting members; and a heat insulating member filled in a clearance between the intermediate member, the first and second supporting members and the vibration deadening washer between the inner plate and the outer plate, wherein a plurality of holes through which the second supporting members are passed are provided in the intermediate member in the lengthwise direction of the intermediate member, and wherein a plurality of holes through which the second supporting member secured at the intermediate member are passed comprises a hole for fixing the vibration deadening washer disposed at the middle part in the lengthwise direction of the intermediate member and at lease one set of loose holes disposed at the symmetrical positions of the intermediate member in the lengthwise direction thereof centering around the corresponding fixing hole.

13. A heat insulating and sound insulating duct wall structure comprising a gas flow channel, the duct wall structure comprising:

an inner plate at a gas flow side;

an outer plate at an atmospheric side;

at least one intermediate member having a lengthwise direction disposed in parallel to the inner plate and outer plate in an intermediate portion between the inner plate and the outer plate;

a plurality of first supporting members both ends of which are, respectively, fixed at the inner plate and intermediate member in order to retain the spacing between the inner plate and the intermediate member;

a plurality of second supporting members both ends of which are, respectively, fixed at the outer plate and intermediate member in order to retain the spacing between the outer plate and the intermediate member;

a vibration deadening washer attached to a connection portion at the intermediate member side of the second supporting members; and a heat insulating member filled in a clearance between the intermediate member, the first and second supporting members and the vibration deadening washer between the inner plate and the outer plate, wherein the inner plate comprises a plurality of inner plate members laminated to each other, and the respective inner plate members are provided with a plurality of holes through which the first supporting member is passed, and wherein a plurality of holes through which the first supporting member secured in the respective inner plate members are provided with a hole for fixing the vibration deadening washer disposed at the middle part of the inner plate member at least one set of loose holes disposed at symmetrical positions of the inner plate members centering around the corresponding fixing hole.

* * * * *